United States Patent [19]

Sato

[11] 4,144,810

[45] Mar. 20, 1979

[54] PORTABLE LABEL PRINTING-DISPENSING MACHINE

[75] Inventor: Yo Sato, Tokyo, Japan

[73] Assignee: Kabushiki Kaisha Sato Kenkyusho, Tokyo, Japan

[21] Appl. No.: 723,556

[22] Filed: Sep. 15, 1976

[30] Foreign Application Priority Data

Oct. 11, 1975 [JP] Japan ..... 50-121783

[51] Int. Cl.[2] ..... B41F 1/08

[52] U.S. Cl. ..... 101/292; 101/57; 101/78; 156/384

[58] Field of Search ..... 101/287, 288, 316, 324–327, 101/291, 292, 41, 57, 78; 156/384

[56] References Cited

U.S. PATENT DOCUMENTS

| | | | |
|---|---|---|---|
| 2,656,063 | 10/1953 | Kafka | 156/384 |
| 3,049,990 | 8/1962 | Brown et al. | 101/41 |
| 3,199,650 | 8/1965 | Brown et al. | 197/18 |
| 3,362,326 | 1/1968 | Delpo et al. | 101/405 |
| 3,798,106 | 3/1974 | Jenkins | 156/384 |
| 3,911,817 | 10/1975 | Becker et al. | 101/288 |
| 4,072,105 | 2/1978 | Becker et al. | 101/288 |

FOREIGN PATENT DOCUMENTS

| | | | |
|---|---|---|---|
| 2428998 | 2/1976 | Fed. Rep. of Germany | 156/384 |

*Primary Examiner*—William Pieprz

*Attorney, Agent, or Firm*—Ostrolenk, Faber, Gerb & Soffen

[57] ABSTRACT

A portable label printing and dispensing machine which includes: a printing device fixed to the machine frame; a movable platen positioned under the printing device; a spring held against exerting a biasing force; means to release the spring to push up the platen to strike against the printing device; and a push back means to separate the platen from the printing device just after printing.

28 Claims, 38 Drawing Figures

PORTABLE LABEL PRINTING-DISPENSING MACHINE

BACKGROUND OF THE INVENTION

This invention relates to a portable label printing and dispensing machine and particularly to the device that moves the labels to be imprinted against the printing device.

A portable label printing and dispensing machine is used for printing indicia, such as price figures and OCR letters, on the surfaces of labels of a label strip. Typically, the printing and dispensing of labels can be performed by squeezing and then releasing the grip and hand lever of the machine.

It is necessary that the labels applied on merchandise always be clearly printed since customers read the prices from the printed labels when they shop and store employees read the prices when they total the sales on a cash register. Price labels are applied to noticeable portions of merchandise so that they might be easily found. Such labels play an important role on the faces of merchandise and they should not hurt the appearance of goods being sold. Accordingly, it is necessary for the labels to be printed clearly.

In the prior art, there are several kinds of label printing and dispensing machines for printing prices on labels and applying the labels to merchandise.

In the portable labeler of U.S. Pat. No. 3,265,553, a hand lever is pivotally supported on the grip portion of the labeler which is integrally formed at the rear end of the machine frame. The labeler has a yoke connected to the hand lever. A printing device is supported at the front end of the yoke. The printing device is thus vertically moved together with the yoke by the movement of the hand lever. With this structure, the printing pressure of the type face on the printing device against the label surface varies with the strength of the squeezing of the hand lever. Further, the amount of ink applied to the label differs with the duration of a squeezing of the hand lever, even when the printing pressure is not varied. Therefore, indicia cannot be printed with constant precision on the labels.

In the portable labeler of U.S. Pat. No. 3,420,172, a hand lever is pivotally attached to the fixed grip on the machine frame. An inking roller is attached to a pin positioned at the upper end of the extension of the hand lever. The printing device is supported by an arm which is pivotally attached to the upper portion of the machine frame and is biased toward the labels by a coil spring. Thus, the printing of the labels on a platen is performed by tension of the coil spring. When the hand lever is squeezed, a cam formed on the upper edge of the hand lever is caused to contact the follower on the printing device support arm and the ink is applied to the type face formed of a group of types of the printing device by means of the inking roller where the printing device is swung above. When the hand lever is released, the printing device is lowered by the force of the above-mentioned spring and a label is thereby printed.

The printing of labels is thus performed with a constant printing pressure caused by the spring, regardlless of whether the hand lever is squeezed strongly or weakly. But, the type face of the printing device remains in contact with the label for a varying period of time. The amount of ink applied varies with the contact time and indicia cannot be imprinted with constant precision on the labels. Furthermore, because the printing device is automatically lowered during the label printing, high precision printing cannot be expected owing to the vibrations generated by the weight of the printing device.

West German Offenlegungsschrift DT-OS No. 1,909,900 discloses a printing device that is affixed to the machine frame. The platen to press labels to the type face of the printing device is positioned in front of a rocking lever, which is separated from a hand lever. When the hand lever is squeezed, the platen supporting a label is raised by the movement of the rocking lever, and the platen pushes the label against the type face. When the hand lever is then released, the platen is lowered.

Like U.S. Pat. No. 3,265,553, the printing pressure of the type face against the label in the German reference varies according to the squeezing force exerted on the hand lever. In addition, the amount of ink applied also varies with the time length of a squeezing of the hand lever, even when the printing pressure is constant. Therefore, clear, consistent and precise printing cannot be performed with this machine.

In the portable labeler disclosed in Japanese patent Laid-Open publication No. 57200 of 1975, a hand lever is pivotally secured to the grip which is integrally formed with the machine frame. A yoke, which is provided with a printing device, is separately supported. Both the hand lever and the yoke are connected by a shaft. A compression spring is interposed between the hand lever and the yoke. The yoke is thus urged to a rest position when the hand lever is released. By providing a pressure receiving device to chuck the printing action of the printing device under a certain level, the printing action is caused by the yoke when the force of the above compression spring to the yoke exceeds the control limit of the above pressure receiving device by the squeezing of the hand lever. Thus, the type face of the printing device is caused to strike against the platen with a constant force without relation to the squeezing strength of the hand lever, that is when the hand lever is squeezed either quickly or slowly. However, the time of contact between the label and the type face of the printing device varies according to the length of time between the squeezing and the releasing of the hand lever. Therefore, the quantity of applied ink varies and clear printing with uniform depth cannot be attained.

With conventional portable labelers, the precision of printing is indeterminate and clearly printed labels of even depth cannot be obtained because the printing conditions vary according to the strength and/or time of the squeezing of the hand lever.

BRIEF SUMMARY OF THE INVENTION

The principal object of the present invention is to provide an improved portable label printing and dispensing machine or labeler.

Another object of the present invention is to provide a labeler with which clear and distinct indicia can be printed on labels.

A further object of the present invention is to provide a novel labeler which works without being influenced of the strength and/or the duration of a squeezing of the hand lever.

Still a further object of the present invention is to provide a novel labeler which can be produced at a moderate cost, provides excellent performance, and is operated with ease and certainty.

In accordance with the present invention, the portable labeler shifts a label strip through a labeler passage, prints the labels of the strip with indicia and then peels the labels off the backing strip so as to apply them on the surfaces of articles. This series of functions can be performed simply by squeezing the hand lever of the labeler. Further, the labeler of the present invention comprises: a stationary printing device fixed to the machine frame; a movable platen positioned under the printing device and receiving the label strip; a platen push up means to strike the platen against the printing device; and a push back means to force the platen to separate from the printing device just after the printing action. The platen is continuously biased toward the printing device and a restraining means blocks motion of the platen toward confrontation with the printing device. The restraining means is normally biased toward its platen motion blocking position. Appropriate camming means attached to the hand lever release the platen to move toward the printing device and cause the platen motion restraining means to return to the blocking position once the platen has been returned to its start position.

BRIEF DESCRIPTION OF THE DRAWINGS

In order that the invention may be more fully understood, preferred embodiments are now described with reference to the accompanying drawings, in which:

FIGS. 7*a*-1, 7*a*-2, 7*b*-1, 7*b*-2, 7*c*-1 and 7*c*-2 show the relationship among the hand lever, inner frame and supporting member of the labeler, where FIGS. 7*a*-1, 7*b*-1 and 7*c*-1 are partial longitudinal cross-sectional views corresponding to the status of FIGS. 3, 4 and 18*d*, respectively; and FIGS. 7*a*-2, 7*b*-2 and 7*c*-2 are horizontal cross-sectional views taken along the lines F—F in FIG. 7*a*-1, G—G in FIG. 7*b*-1 and H—H in FIG. 7*c*-1, respectively;

FIGS. 9*a* and 9*b* are central cross-sectional views of the inner frame, in which FIG. 9*a* shows the normal position of the frame and FIG. 9*b* shows the position of the frame during loading of the label strip;

DESCRIPTION OF THE PREFERRED EMBODIMENTS

Figure 1:
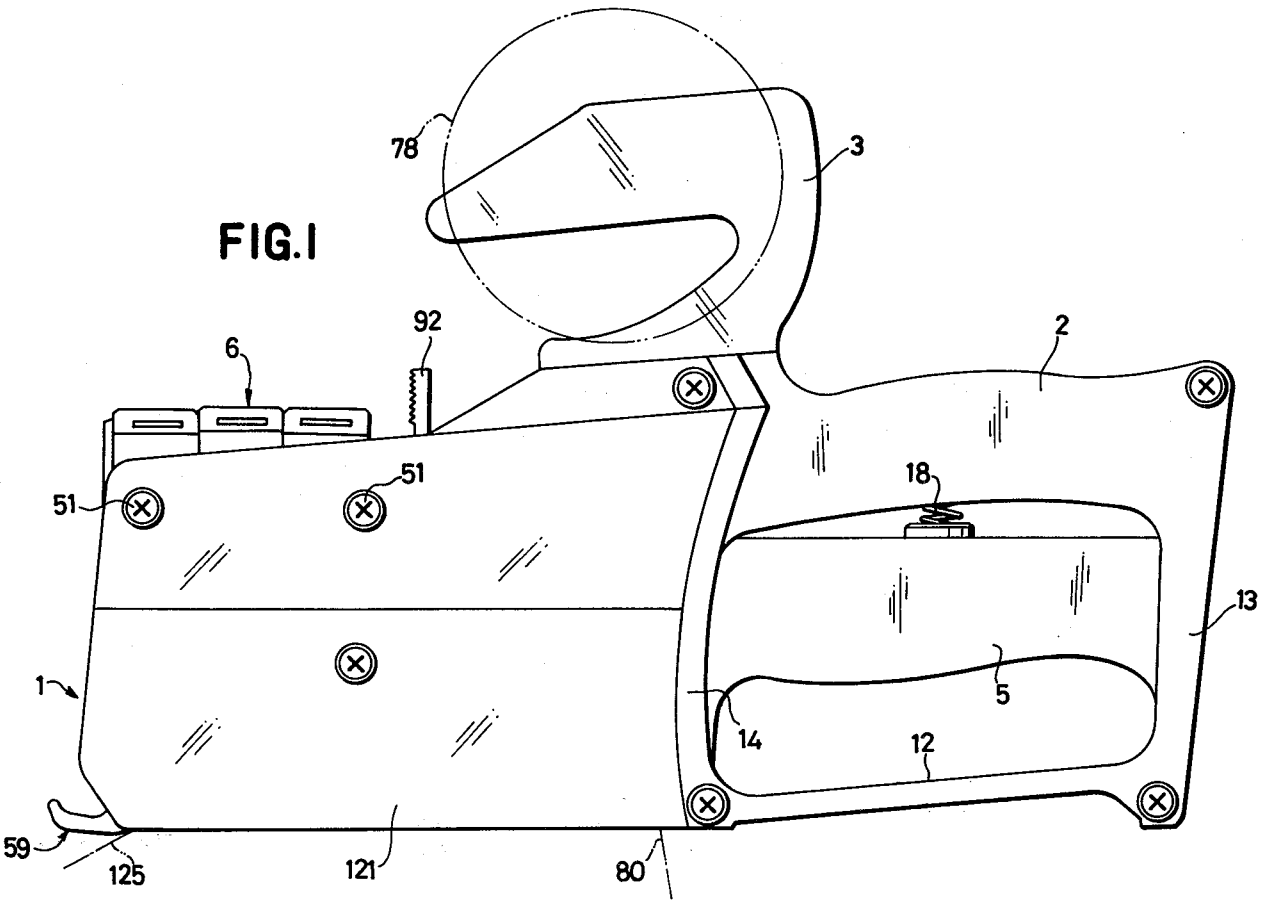
FIG. 1 is a side elevational view of a labeler provided with a first embodiment of printing pressure control mechanism according to the present invention.
Figure 2:
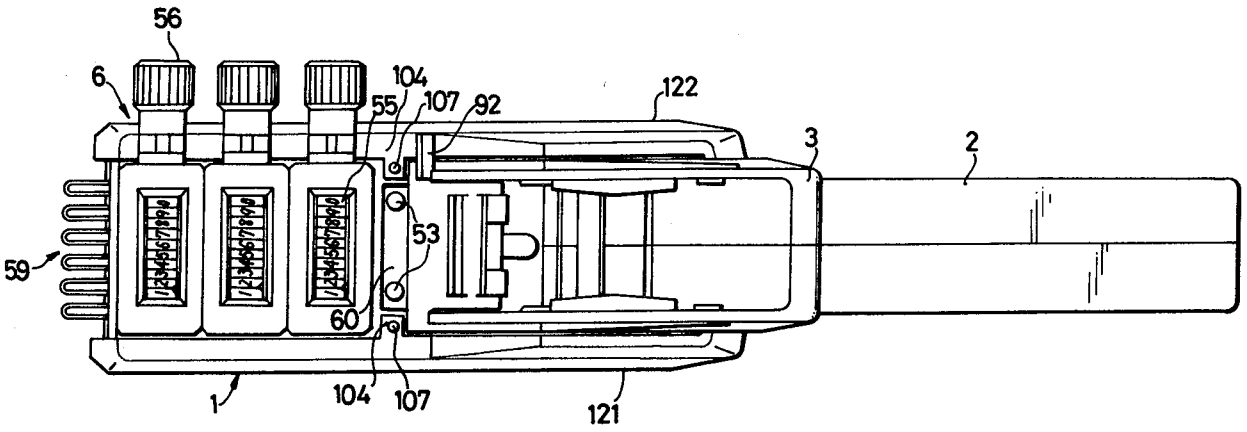
FIG. 2 is a plan view of the labeler.
Figure 3:
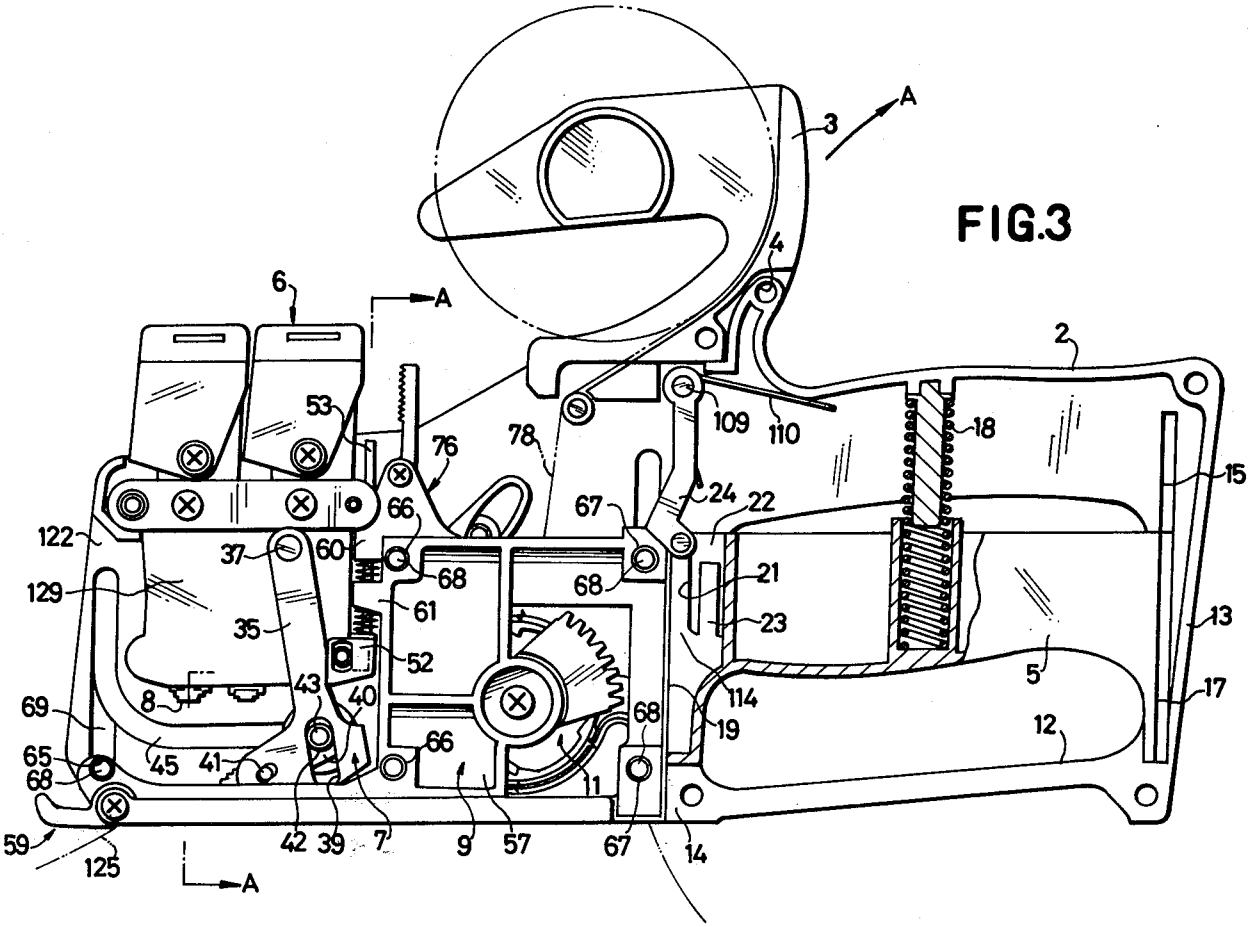
FIG. 3 is a side elevational view of the labeler and similar to FIG. 1, in which the side wall on this side of the labeler has been removed and a portion of the labeler is cut away.

Referring to FIGS. 1–3, the first embodiment of the labeler of the present invention is now described.

The frame 1 of the labeler is comprised of a pair of side walls 121 and 122. The frame has an integral grip 2 at its rear (right hand) portion. The frame includes a holder 3 for supporting a rolled label strip 78 above the upper middle portion of the frame. The holder 3 is pivotally mounted to a shaft 4 on the frame. A hand lever 5 moves vertically and is supported to move so that it remains oriented parallel to the grip 2. A printing device 6 is affixed to the upper front portion of the labeler.

A label application device 59 is attached forwardly of and near the front end of the platen 10 for receiving and applying separated printed labels. A type inking device for applying ink to the type faces 8 of the printing device 6 is provided inside the frame.

There is an inner frame 9, which is positioned between the printing device 6 and the hand lever 5. The inner frame 9 is integrally provided with a forwardly projecting platen 10 that is disposed under the printing device 6. The frame 9 supports a label advancing mechanism 11. The label advancing mechanism 11 for feeding the label strip 78 and the carrier or backup strip 80 is placed between the printing device 6 and the hand lever 5. The frame 9 is moved vertically together with and remains oriented parallel to the hand lever 5.

Figure 4:
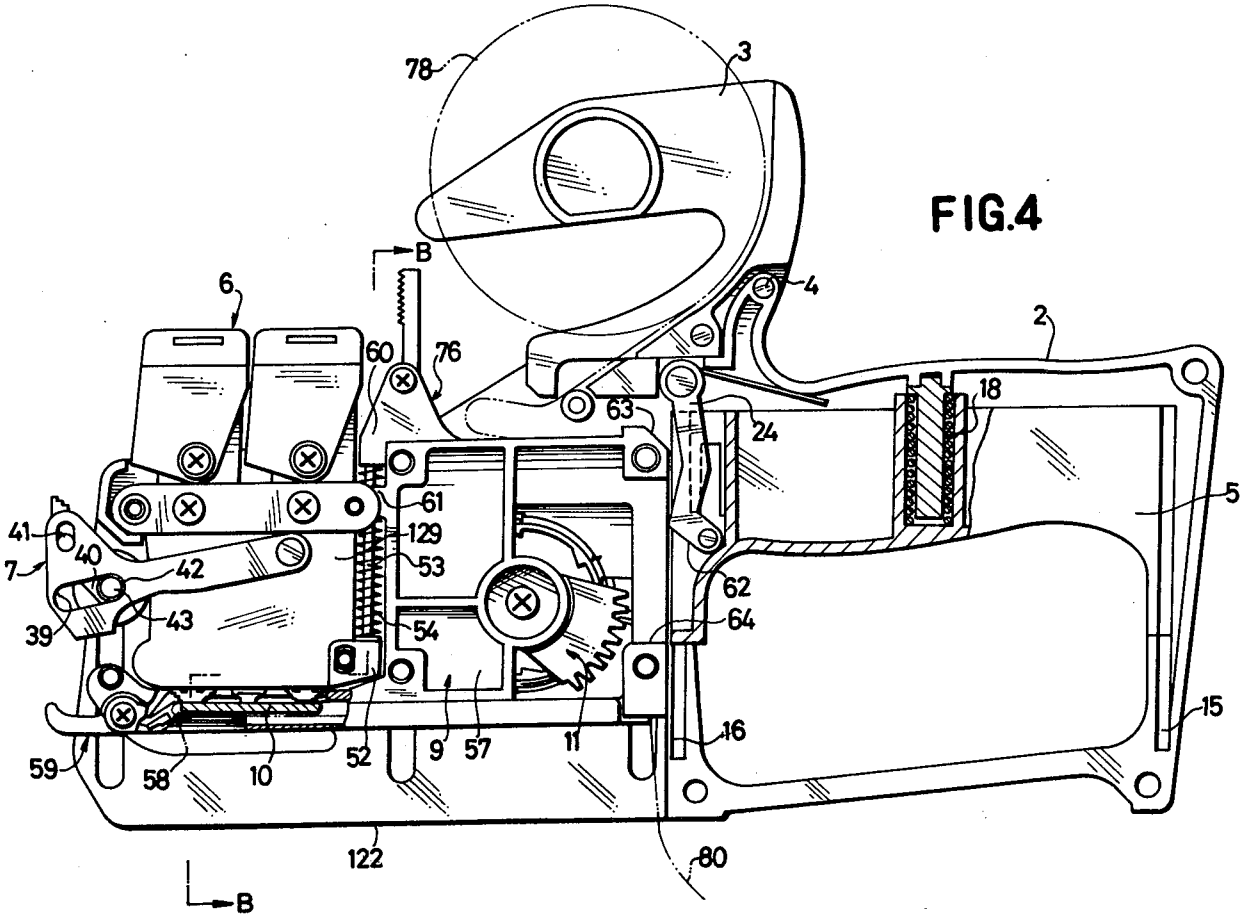
FIG. 4 is a side elevational view similar to FIG. 3, in which the hand lever has been squeezed and the platen is striking a label against the type face.
Figure 5:
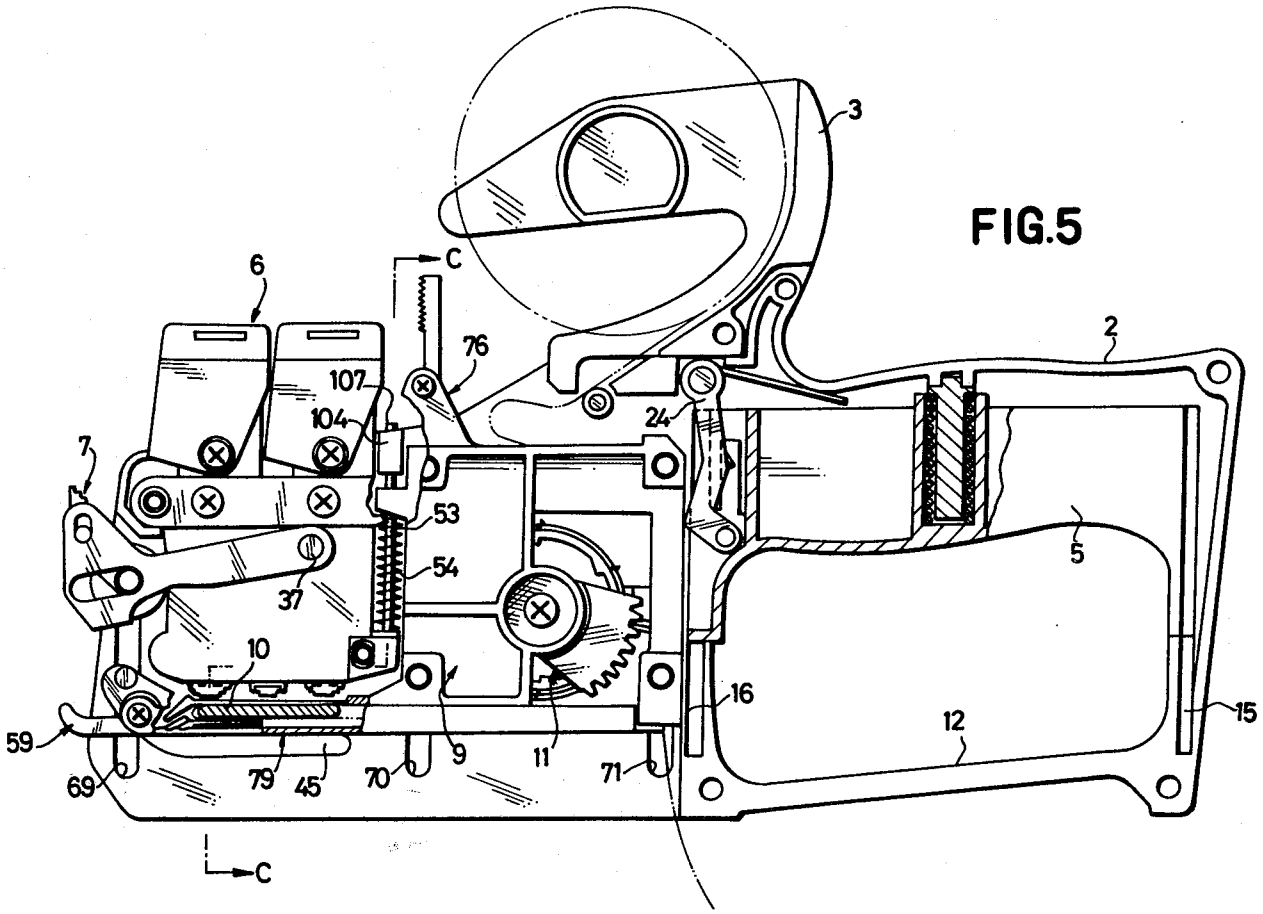
FIG. 5 is a side elevational view similar to FIG. 3, in which the platen has been slightly pushed back after the stroke of the platen against the type face.
Figure 6:
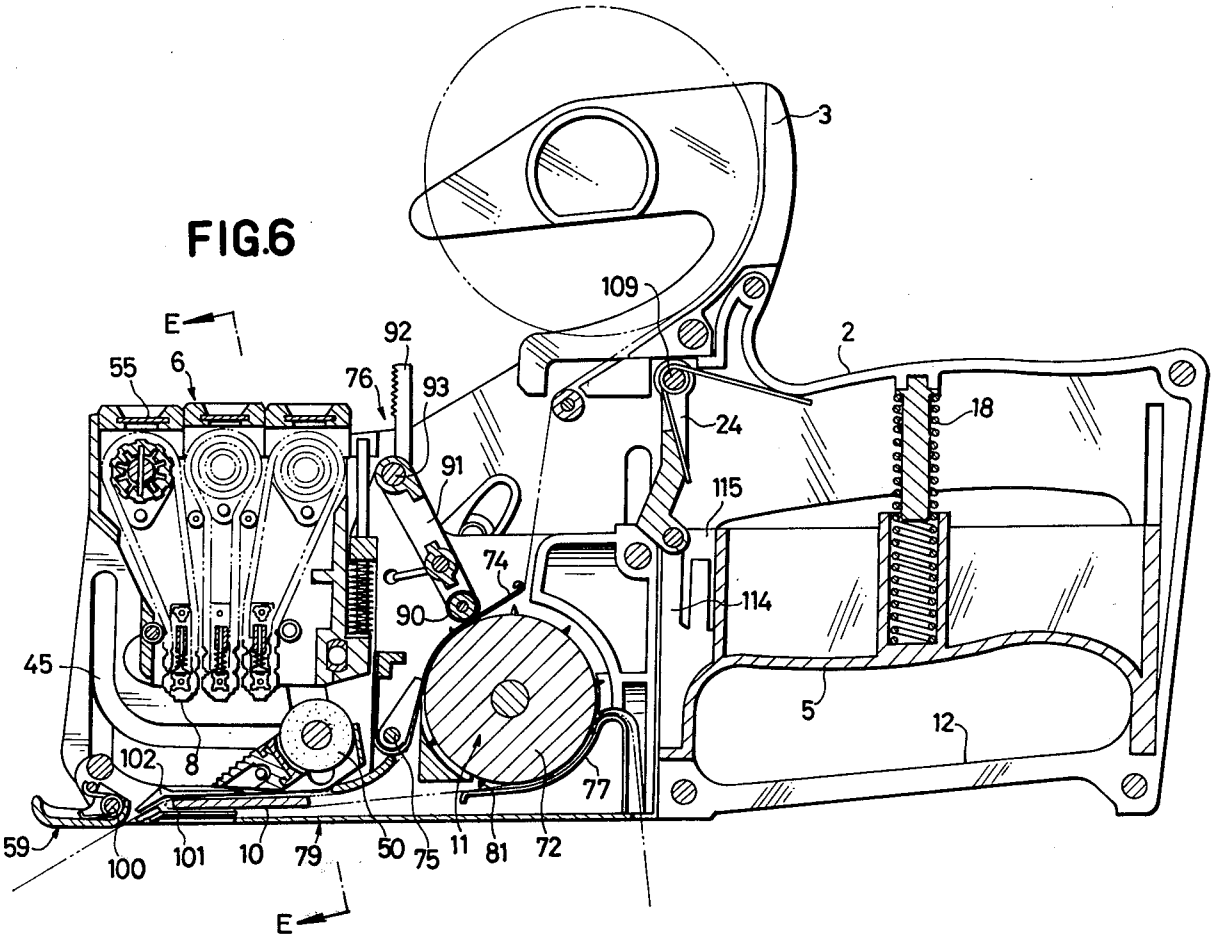
FIG. 6 is a central cross-sectional view of the labeler, also similar to FIG. 3.

As shown in FIGS. 3 to 5, a large size opening 12 is formed below the grip 2 into which an operator's fingers may be inserted. The inside surfaces of a pair of vertical rear frame portions 13 and of another pair of opposite vertical front frame portions 14 are placed behind and in front of the lever 5, respectively, and these frame portions are respectively provided with vertically elongated handle motion guide grooves 15 and 16. The lugs 17 formed on both sides of the front and rear ends of the hand lever 5 engage in the grooves 15 and 16, whereby the hand lever 5 is guided to move vertically. A compression spring 18 is interposed between the hand lever 5 and the grip 2 to urge the hand lever 5 downwardly along the long grooves 15 and 16 and contrary to the gripping motion.

Figures 1, 2, 7A, 7B, 7C:
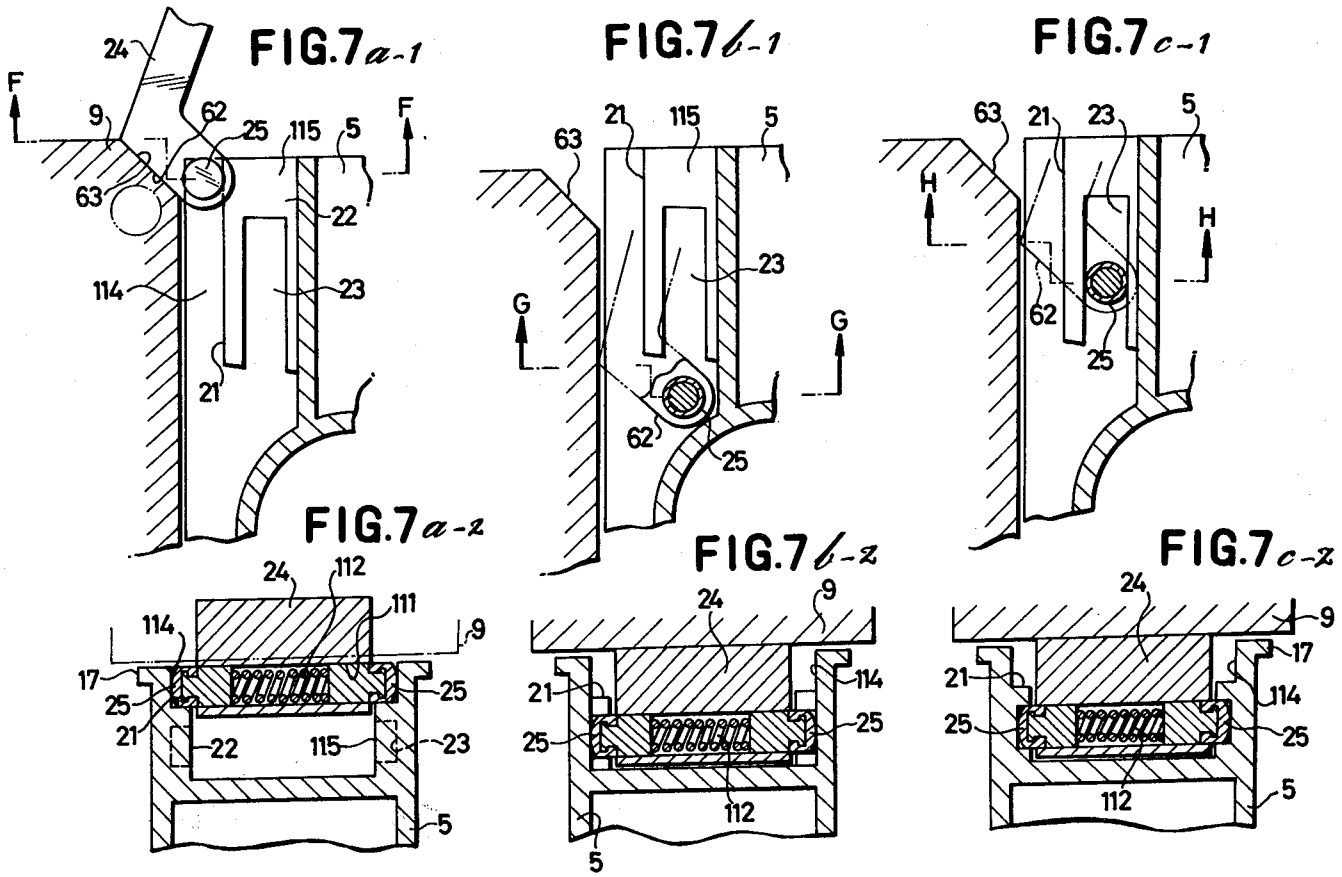
Figure 8:
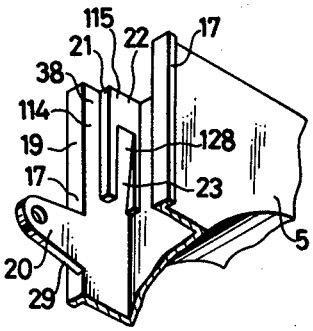
FIG. 8 is a perspective view of the cam portion of the hand lever.

As shown in FIGS. 7 and 8, on the front side of the hand lever 5 there is a U-shaped (in plan section) outer channel 38 that is defined by opposed, thick side walls 19. The side walls 19 are integrally provided with projecting pieces 20 located toward their fronts and at their lower ends.

The below described inner frame 9 is forced down by the bottom surface 29 of the projecting pieces 20 and this engagement causes the projecting pieces 20 and the spring 18 to serve as a return means for the platen 10 and the inner frame 9.

The inside wall surfaces 114 of the side walls 19 support respective cam forming walls 21. The surfaces 114 nearer to inner frame 9 one cam or guide channel. The facing, opposed inside wall surfaces of the cam forming walls 21 define another narrower width inner channel 22 across the space between walls 19 and inside the outer channel 38. Each wall 21 has an inclined surface 128 that runs downwardly and inwardly from the inside wall surface 115 of the inner channel 22 to the inside wall surface 114 of the outer channel 38 and thereby forms an inclined guide passage 23. This passage forms another cam or guide channel. The cam follower, i.e. roller 25 of a supporting member 24 is caused to engage both the inside portions of the walls 19 and the walls 21 between the side walls defining the passage 23, as described below.

Figure 18A:
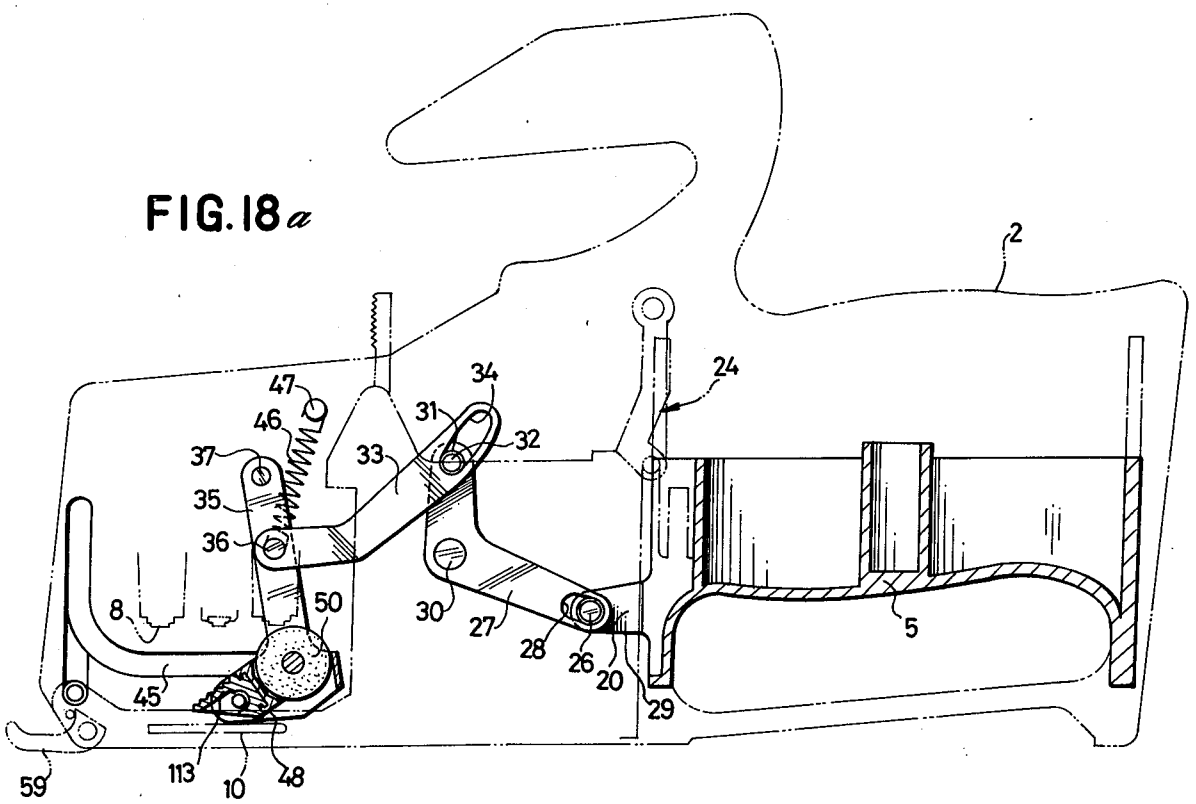
FIGS. 18*a*, 18*b*, 18*c*, 18*d* and 18*e* show various stages in the relationship between the inking device and the hand lever.

The projecting piece 20 positioned on the edge of the side wall 19 is attached to a bell crank 27 by a pin 26 passing through a slot 28 in crank 27, as shown in FIG. 18*a*, for operating the inking device. The bell crank 27 is pivotally connected to the side wall 122 of the machine frame 1 by a pin 30. The other end of the bell crank 27 has a roller 31 pivotally secured thereto by a pin 32. One end of a link 33 has a slot 34 and is connected to the bell crank 27 by the roller 31 riding in the slot 34. The other end of the link 33 is pivotally attached to the middle portion of a rocking lever 35 by a pivot pin 36. The upper end of the rocking lever 35 is pivotally attached to side frame 129 (FIG. 3) of the printing device 6 by pivot pins 37.

Figure 19:
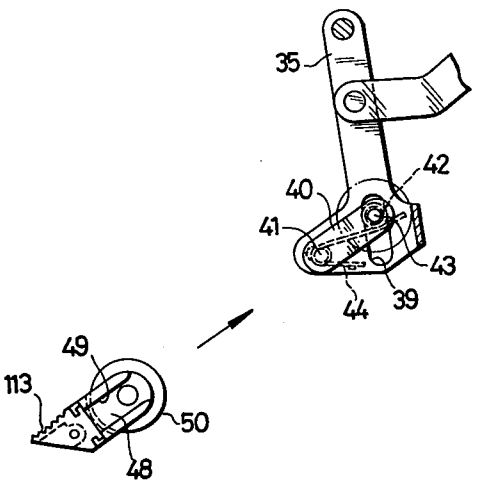
FIG. 19 is an explanatory drawing showing the means for inking the printing device.
Figure 13:
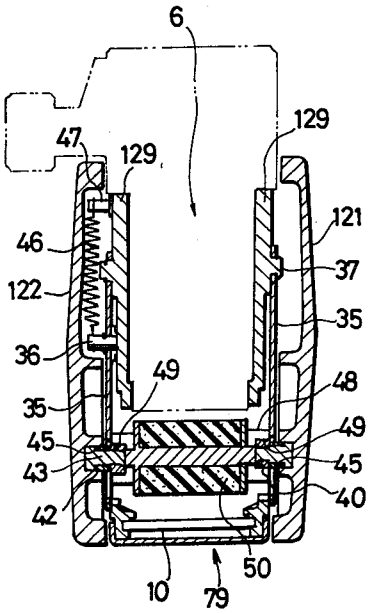
FIG. 13 is a cross-sectional view taken along the line E—E in FIG. 6.

As shown in FIGS. 3 and 19, a slot 39 is formed at the lower, free end of the rocking lever 35. A link 40 is pivotally attached to another forward slot in the lower portion of lever 35 by the pivot pin 41. The link 40 rocks about the pin 41. The free rear end of the link 40 carries a roller 42 which is fitted to the slot 39 in lever 35. The end of the link 40 carrying roller 42 is urged in the direction of the printing device 6 by a torsion spring 44 wound around the pin 41. As shown in FIG. 13, the roller 42 of the link 40 is loosely fitted into the slot 39 of the rocking lever 35 and projects through the slot 39. Although only one lever 35 and one set of elements connected thereto are illustrated, there is usually a set of corresponding elements on both sides of the labeler. Within the range of motion of the roller 42 along the vertically elongated slot 39 of the rocking lever 35, the side walls 121 and 122 of the machine frame are provided with respective guide grooves 45 running beneath the printing device 6.

The rollers 42 are also guided through the guide grooves 45 and as they so move, the links 40 are caused to rock about pin 41.

Figure 18:
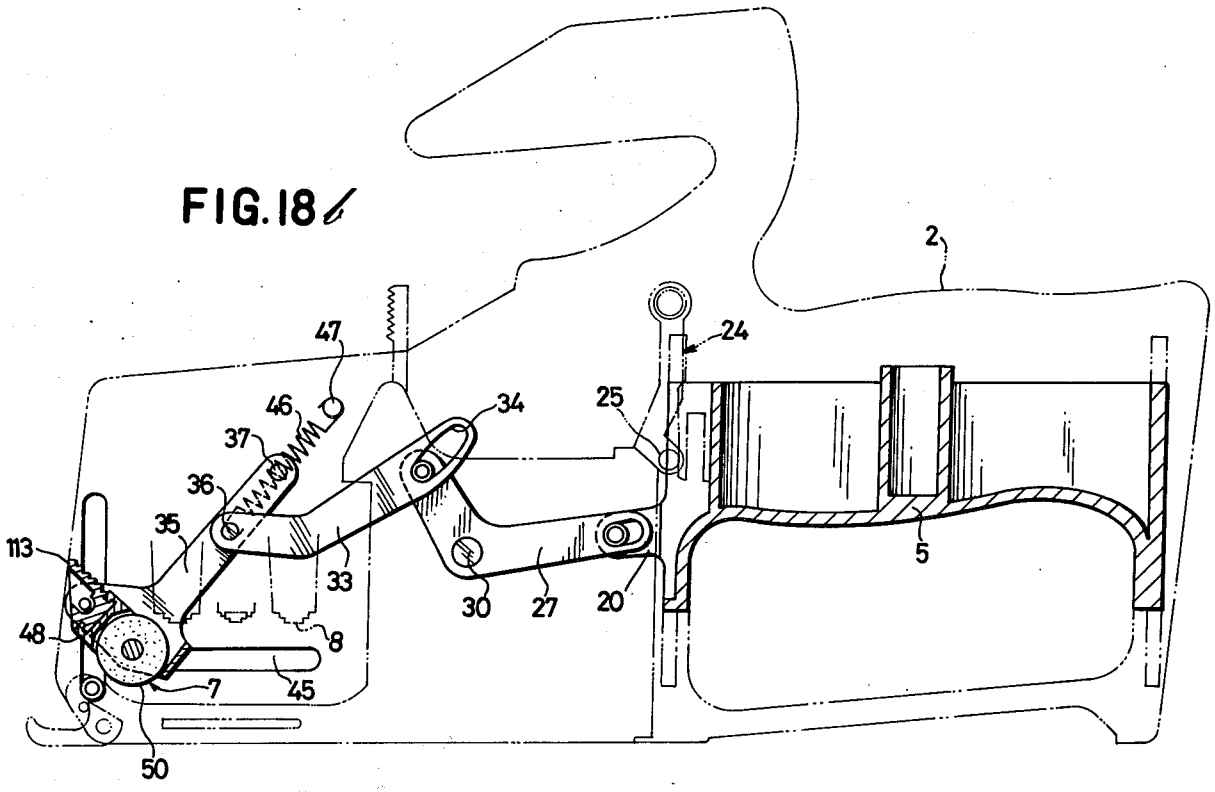
Figure 18E:
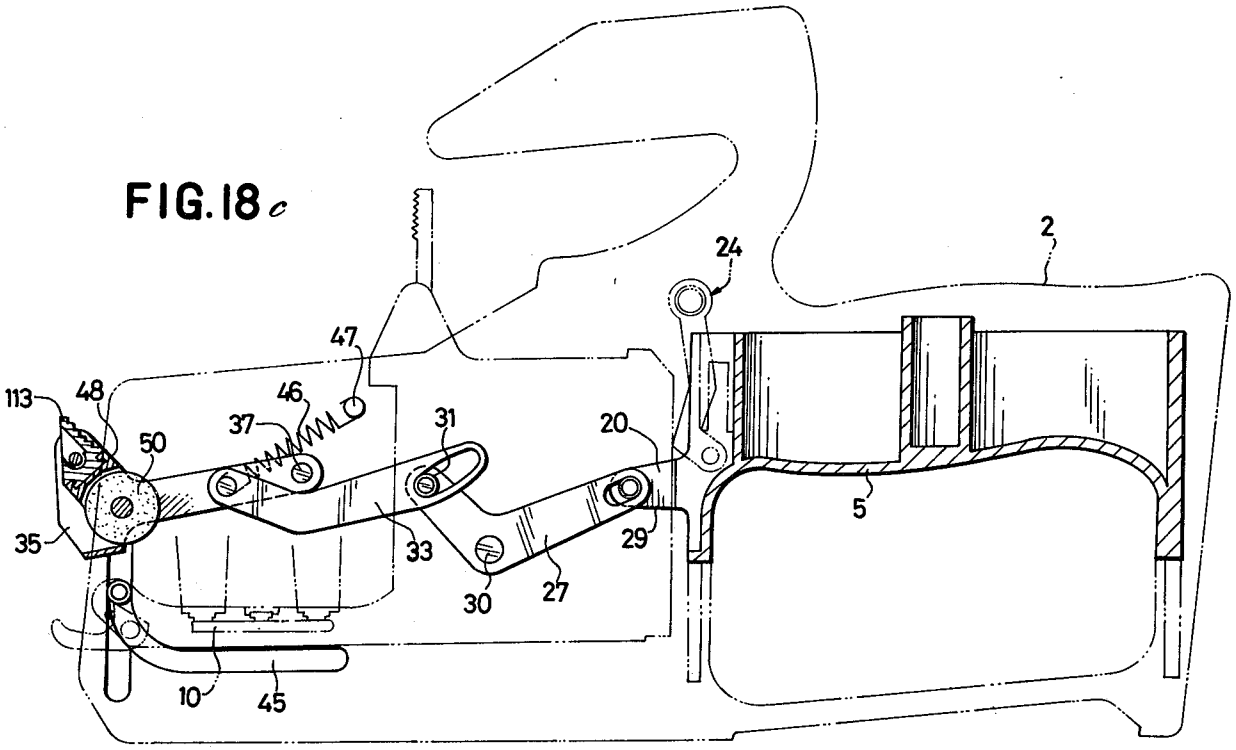

As shown in FIG. 18, a tensioned coil spring 46 is attached between the pin 36 on the rocking lever 35 and a pin 47 projecting from the side frame 129 of the printing device 6 to define an over center device. When the pin 36 deviates from the straight line between the pins 37 and 47, the rocking lever 35 is biased in the direction of such deviation by the spring 46.

As shown in FIG. 19, the grooved lugs 49 on the leg portions of a cartridge frame 48 are detachably secured to the links 40. Frame 48 holds the ink impregnated roller 50. The cartridge frame 48 has an integral graspable finger piece 113, by which the detaching of the cartridge frame 48 from the links 40 can be performed.

As shown in FIGS. 1–3, the printing device 6 is mounted to the housing 1 with a plurality of screws 51. The printing device is provided with projecting lower supports 52 at its rear lower portion. The lower supports 52 carry vertical support pins 53 around which the printing pressure springs 54 are held.

Figure 9A:
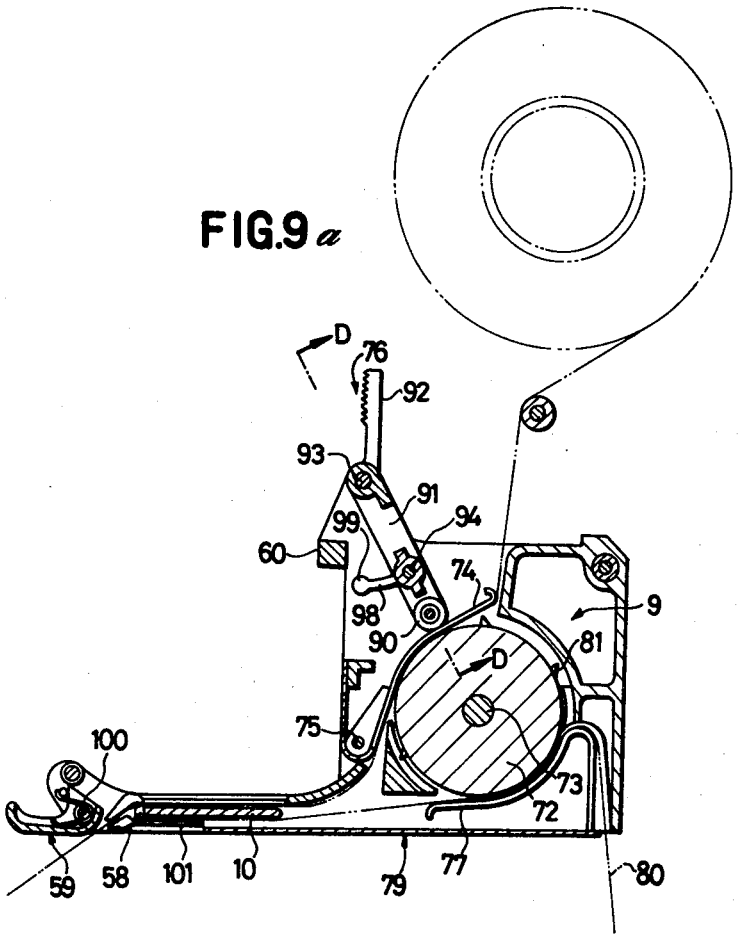
Figure 9:
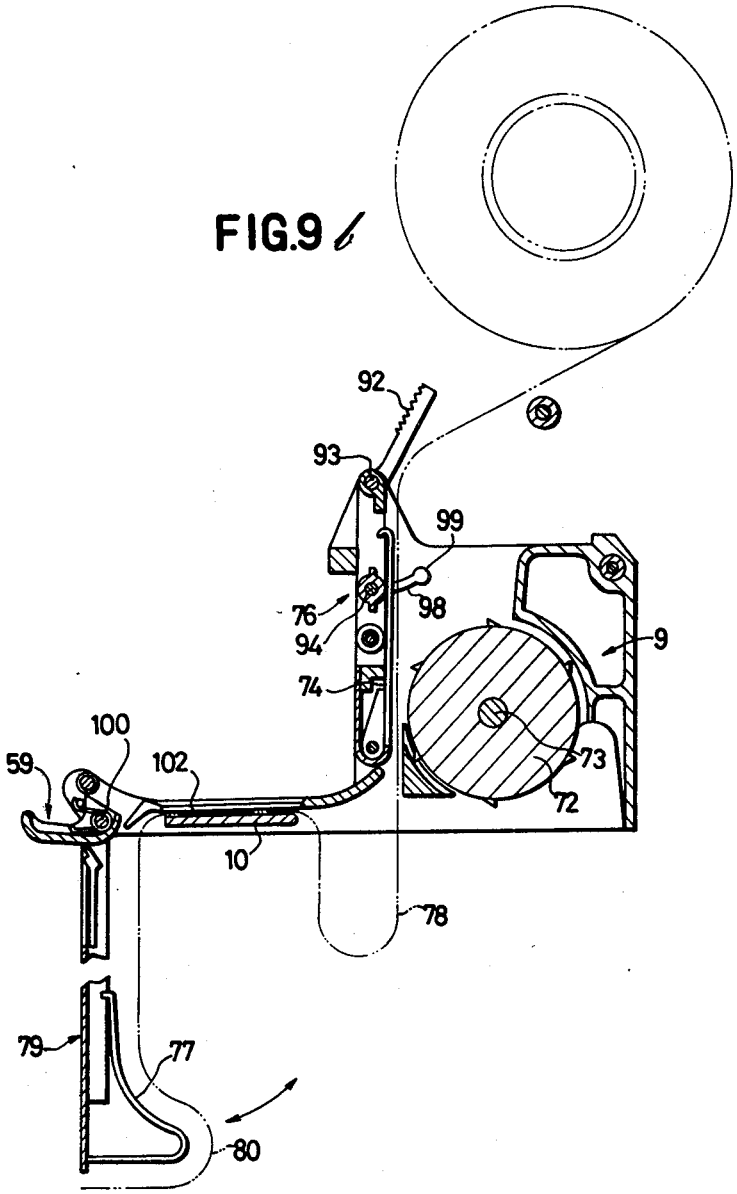
Figure 16:
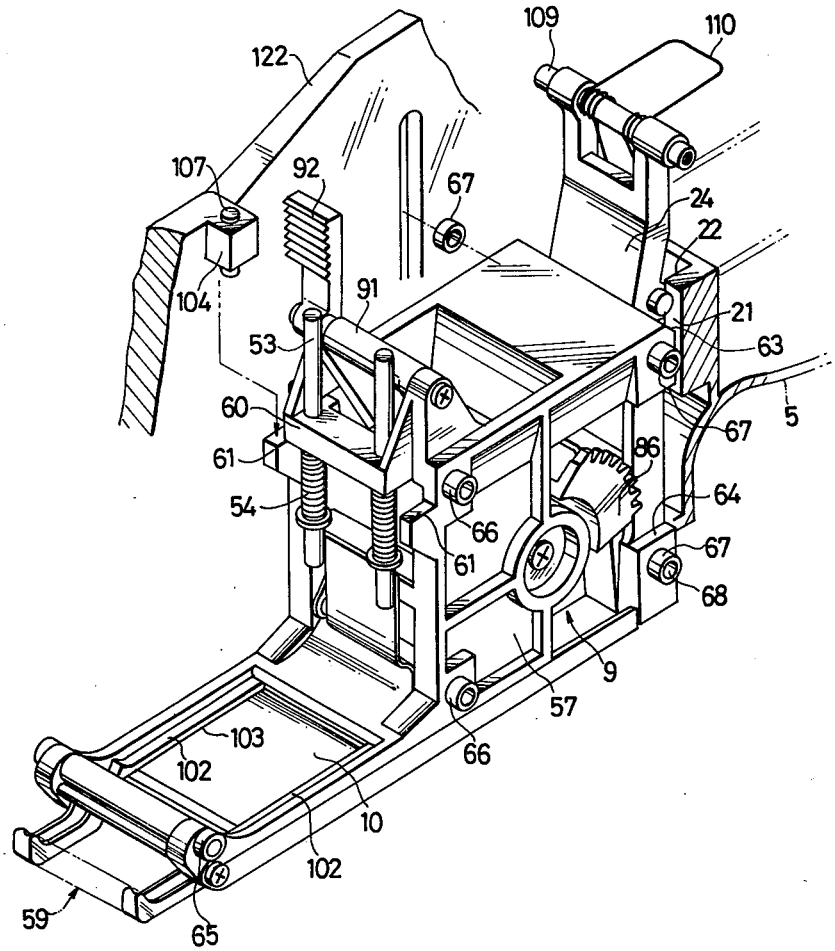
FIG. 16 is a perspective view mainly showing the inner frame.

As shown in FIGS. 4, 9 and 16, the inner frame 9 comprises side plates 57 which are parallel to and located beteen side walls 121 and 122. The side plates 57 are spanned by the platen 10 which extends under the type face 8 of the printing device 6.

At the upper portion of the inner frame 9, there is an upper support 60 which faces lower support 52 on the printing device 6. The spring 54 are supported between lower support 52 and upper support 60. The spring support pins 53 are inserted through openings in the upper support 60. Further, on both outer sides of the upper support 60, push-back spring lugs 61 facing in the counter direction are formed.

As shown in FIGS. 4, 7 and 16, an inclined surface 63 is formed on the rear upper corner of the inner frame 9. This inclined surface 63 is engageable with the correspondingly inclined surface 62 of the supporting member 24. The engagement between these surfaces causes the supporting member 24 to act as a restraining means for restraining motion of the platen 10 and inner frame 9. Further projections 64 are formed on and extend sideways out from both lower sides of the inner frame 9. The projections 64 are engaged by the bottom surfaces 29 of the projecting pieces 20 (FIG. 8) of the hand lever 5 such that descent or spring biased retraction of lever 5 pushes the inner frame 9 downward.

As shown in FIG. 3, rollers 65, 66 and 67 are secured to pins 68 positioned at the front, rear, right, left, upper and lower portions of the side plate 57. The rollers 65, 66 and 67 move in and along the vertical guide grooves 69, 70 and 71, respectively, which grooves are formed in the side walls 121 and 122, whereby the inner frame 9 is movable vertically and remains at a constant tilt orientation.

As shown in FIG. 9, the inner frame 9 is provided with a rotating label strip feed member 72 at its middle portion. The rotating member 72 is mounted on a main shaft 73 on frame 9. Member 72 advances both the label strip 78 and the backup strin 80. A guide spring plate 74 is pivotally secured to a pivot pin 75 on frame 9 for guiding the label strip 78 over the rotating member 72. A pushing device 76 is attached at the upper portion of the inner frame 9 for pushing the guide spring plate 74. When the guide spring plate 74 is pushed toward the rotating member 72, a label passage having a slightly larger clearance than the thickness of the label strip 78 is formed. Additionally, a guide member 77, for guiding the backup strip 80 past the underside of member 72, is fixed to the bottom cover 79 so as to form a backup strip passage having a slightly larger clearance than the thickness of the backup strip 80.

Figure 10A:
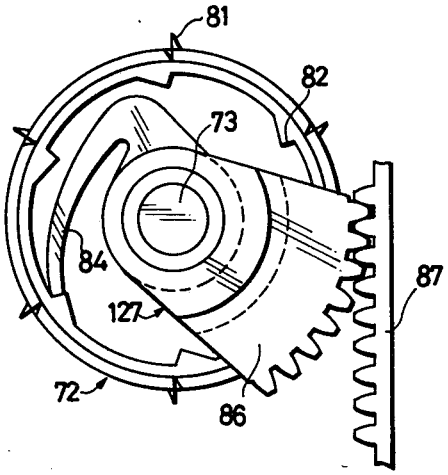
FIGS. 10*a*, 10*b* and 10*c* are side views showing a label strip feed mechanism.

As shown in FIGS. 10*a, b* and *c*, the rotating member 72 has label strip engaging teeth 81 on its periphery. The rotating member 72 has inner projections 82 with the same spacing as and location around the member 72 as the teeth 81. Projections 82 are formed at one side of the rotating member 72 adjacent to the side wall 121. Internal recesses 83, with the same spacing and location around the member 72 as the teeth 81 are formed on the other side of the rotating member adjacent to the side wall 122.

A driving member 127 comprised of a sector gear 86 on one side of shaft 73 and a rotating resilient pawl 84 on the opposite side of shaft 73 is rotatably mounted on the main shaft 73. The rotating pawl 84 is radially outwardly biased to engage the inner projections 82 of the rotating member 72, but only in one rotational direction, counterclockwise in FIG. 10.

In order to prevent reverse rotation of the rotating member 72, a rotation reversal preventing member 124 having reverse rotation preventing pieces 85 is fitted to the main shaft 73 and is also nonmovably attached to the side wall 57 of the inner frame 1 with projections 126. The outwardly spring biased pieces 85 of member 124 engage recesses 83.

The sector gear 86 is in the space between the machine frame side wall 121 and the inner frame side plate 57. The teeth of the sector gear 86 engage the rack 87, which is secured to the side wall 121. With the vertical movement of the inner frame 9, the sector gear 86 is rocked around the main shaft 74 by its engagement with the rack 87.

The rotating pawl 84 is turned along with the sector gear 86. However, when the inner frame 9 rises, the movement of the rotating member 72 is stopped by the reversal preventing pieces 85 so that the rotating pawl 84 slides over one inner projection 82 without beig stopped by it. Upon the lowering of the inner frame 9, the inner projection 82 of the rotating member 72 fixedly abuttingly engages the rotating pawl 84. The rotating member 72 is turned counterclockwise in FIG. 10*a* by thhe movement of the rotating pawl 84 and sector gear 86, and such turning is not inhibited by the reversal preventing pieces 85.

Figure 17A:
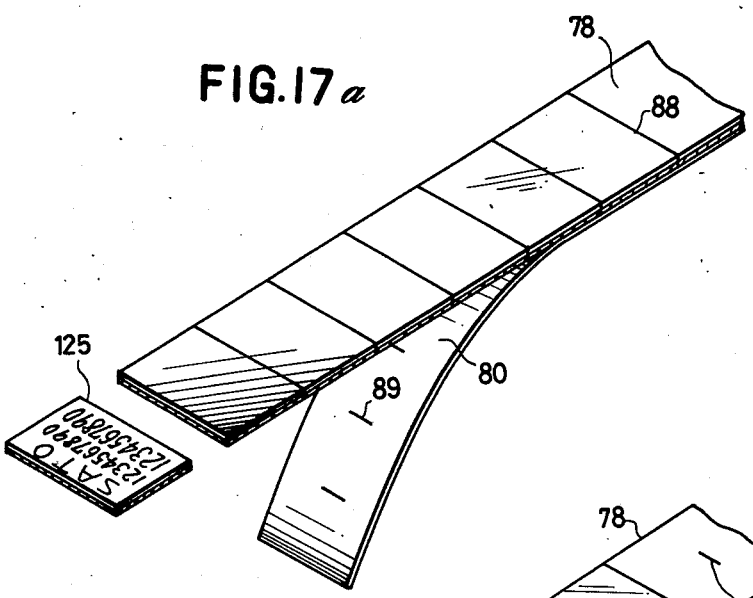
FIGS. 17*a* and 17*b* are perspective views of the label strip.
Figure 17B:
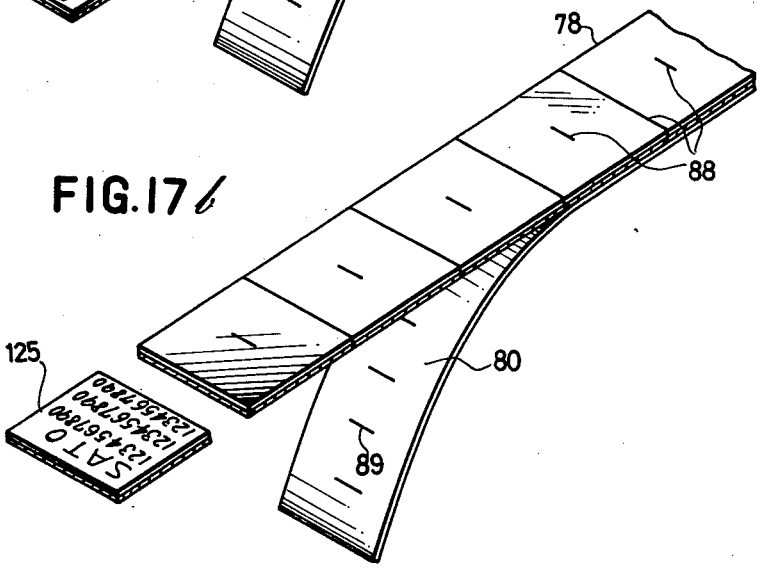

By one reciprocating motion of the inner frame 9, the rotating member 72 is turned the angular distance from one inner projection 82 to another adjacent inner projection 82, which is also the angular distance between two label strip advancing teeth 81. As shown in FIG. 17, during this rotary motion, the slits 88 of the label strip 78 are pierced by the advancing teeth 81 at the top of rotating member 72 and the slits 89 of the carrier strip 80 are pierced by the advancing teeth 81 at the lower portion on rotating member 72. Thus, one label length of the combined label strip 78 and the separated carrier strip 80 are advanced.

As shown in FIGS. 9*a* and *b*, the label strip 78 is guided by the guide spring plate 74 around the upper peripheral section of the rotating member 72. Thus, the slits 88 are securely engaged by the advancing teeth 81. The carrier strip 80 is guided by the guide member 77 around the lower periphery of the rotating member 72 so that the slits 89 of the carrier strip 80 are also engaged. One end of the guide spring plate 74 is pivotally secured to the inner plates 57 by a pin 75. The other end of the spring plate 74 is free to move. This free end of the spring plate 74 is pushed against the surface of the rotating member 72 by a pushing roller 90 of the pushing device 76, whereby the label strip 78 is securely held between the guide spring plate 74 and the rotating member 72. The clearance space between the label passage formed between the rotating member 72 and the guide spring plate 74 is slightly larger than the thickness of the label strip 78 so as not to damage the label surface.

Figure 12:
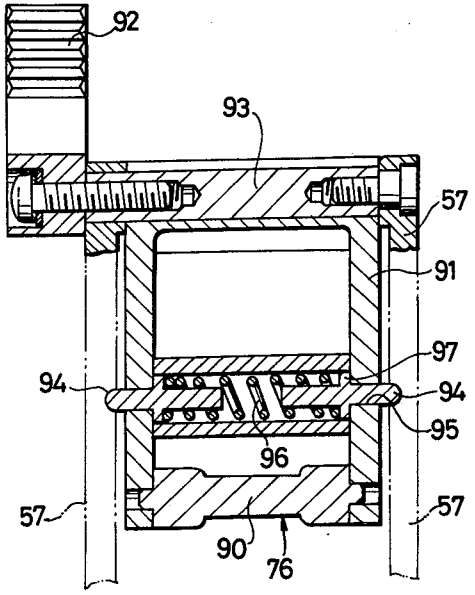
FIG. 12 is a cross-sectional view taken along the line D—D in FIG. 9*a*.

As shown in FIGS. 9 and 12, the pushing device 76 comprises a rocking member 91 and a grip piece 92. Both of these are pivotally secured to the inner plates 57 by a shaft 93. The pushing roller 90 is attached to the rocking member 91. Locating pins 94 are placed between the pushing roller 90 and the shaft 93, and the tips of the pins 94 are inserted into apertures 95 of the rocking member 91. The pins 94 are urged into the apertures by a coil spring 96. The pins 94 have flanges 97 thereon which are biased against the rocking member 91. The tip ends of the locating pins 94 are brought into contact with the side plates 57. To receive the pins 94, the side plates 57 are provided with grooves 98 (FIG. 9) The locating pins 94 are guided along the grooves 98. Furthermore, enlargements 99 are formed at both ends of the grooves 98 where the rocking member 91 is stopped.

The rocking member 91 is moved by operating the grip piece 92. When the grip piece 92 is pulled clockwise toward hand level 5, the rocking member 91 is moved clockwise around the shaft 93, as shown in FIG. 9*b*. The pushing roller 90 is released from the guide spring plate 74, and the spring plate 74 separates from the rotating member 72. In this step, the guide spring plate 74 stands straight due to its own elasticity. On the other hand, when the grip piece 92 is pushed toward the printing device 6, the guide spring plate 74 is pushed to the rotating member 72, as shown in FIG. 9*a*. The guide member 77 for guiding the backup strip 80 along the lower surface of the rotating member 72 is affixed to the bottom cover 79. The bottom cover 79 is pivotally secured to the fixedly located shaft 100 of the label applicator 59, so that the bottom cover 79 can be swung open around the shaft 100. This enables the backup strip 80 to be introduced into the space between the guide member 77 and the rotating member 72.

Figure 14:
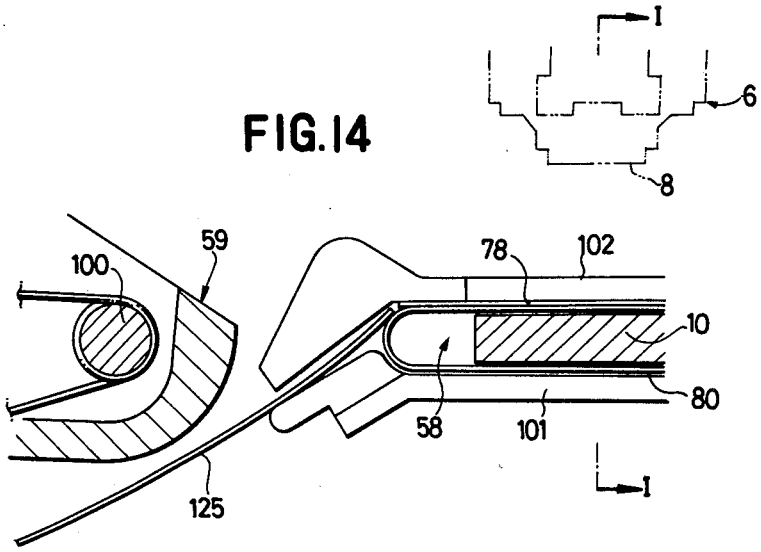
FIG. 14 is an enlarged cross-sectional view of the label peeling section shown in FIG. 6.
Figure 15:
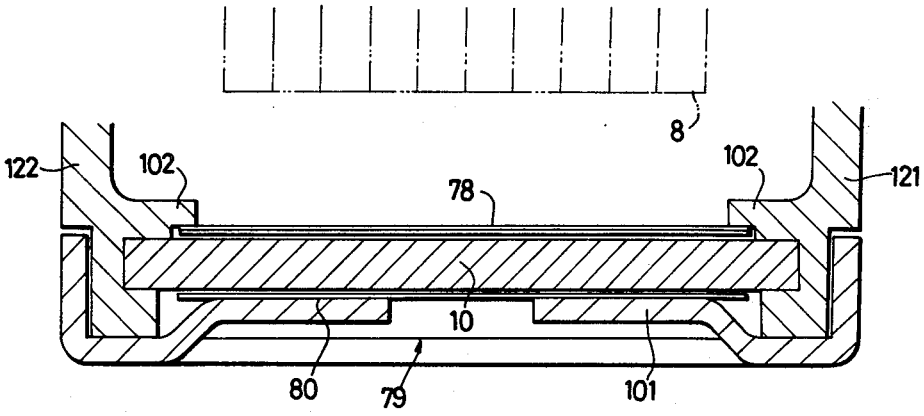
FIG. 15 is a cross-sectional view taken along the line I—I in FIG. 14.

As shown in FIGS. 9*a*, 14 and 15, the bottom cover 79 supports the guide plates 101 atop it and near the label applicator 59. The guide plates 101 and the platen 10 above plates 101 define a guide passage for the backup strip 80. The upper surface of the platen 10 together with the guide pieces 102 which are formed on the side walls 121 and 122 forms another passage for the label strip 78. As shown in FIG. 16, the middle portions of the guide pieces 102 are cut out to form a window 103 for receiving the type face 8 of the printing device 6. The guide pieces still guide the label strip 78 by holding both of its side edges. As shown in FIG. 14, a narrow gap between the guide plates 101 and guide pieces 102 near the front end of the platen 10 defines a label peeling section 58. The label 125 is peeled off the backup strip 80 within this gap as the backing strip is bent in reverse while the label travels forward.

Figure 11A:
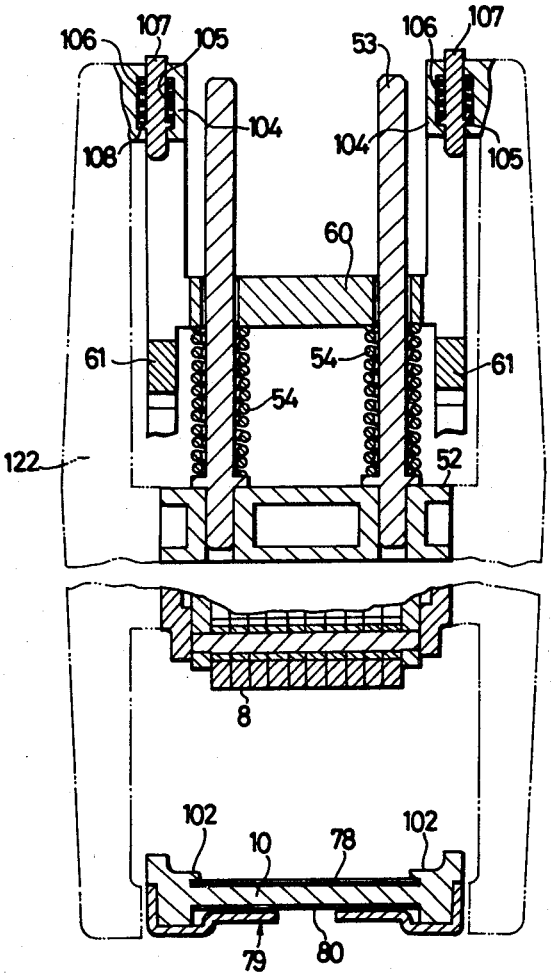
FIGS. 11*a*, 11*b* and 11*c* are enlarged partial cross-sectional views taken along the lines A—A in FIG. 3, B—B in FIG. 4 and C—C in FIG. 5, respectively.
Figure 11:
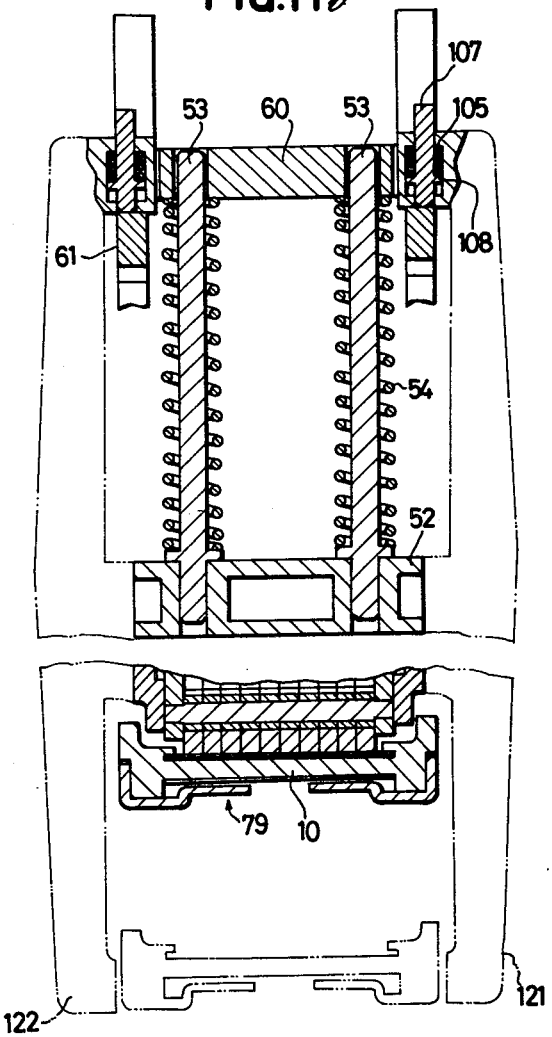

As shown in FIGS. 2, 11 and 16, the insides of the side walls 121 and 122 near their tops are both provided with inward projections 104. Apertures 105 are formed inside the portions of the projections 104 directly above the push back spring lugs 61 on the inside frames 51. Push back springs 106 and pins 107 are inserted in the apertures 105. The pins 107 are held within the apertures 105 by respective flanges 108. The tips of the pins 107 stick out of the bottom faces of the projections 104. The foregoing defines a separation means for moving the platen away from its configuration with the printing device. Thus, when the inner frame 9 is raised, the pins 107 are engaged by the push back spring lugs 61 of the inner frame 9.

Turning to FIG. 11, when the inner frame 9 is raised by the force of the printing pressure springs 54, it rises until the bottom surfaces of the projections 104 engage the upper surfaces of the push back spring lugs 61, as shown in FIG. 11*b*. This occurs before the platen 10 has been raised far enough to contact the label strip 78 against the type face 8. Because the inner frame 9 has inertia, it continues slightly up beyond the initial contact point until the labels 78 and type face 8 engage. The springs 106 and the weight of frame 9 slow the upward movement of the frame 9 so that excessive pressure against the type face 8 by the platen 10 is prevented and deformation of type face 8 or other problems in the printing can be prevented.

The strength of the push back springs 106 is larger than the force exerted by the extending printing pressure springs 54 when the inner frame 9 has risen. When the inner frame 9 is raised and printing is performed by pushing the label strip 78 against the type face 8, the pins 107 are pushed by the lugs 61, as shown in FIG. 11*b* and the push back springs 106 force back the lugs 61 instantaneously so that the platen 10 and lugs 61 are in the state shown in FIG. 11*C*. Thus, the type face 8 and the printed surface of the label strip 78 are instantly separated following printing.

As shown in FIGS. 3 to 8 and 16, the means for restraining motion of the platen and the inner frame 9, i.e. the supporting member 24, is pivotally supported on a pivot shaft 109 carried in the frame walls 121 and 122 and it is urged in the direction of the inner frame 9 by a torsion spring 110 which is wound on the shaft 109. As shown in FIGS. 7*a*-1 and 7*a*-2, the rollers 25 at the free end of the supporting member 24 are pushed sideways of the supporting member 24 by a spring 112 held within a through hole 111 in the member 24. However, the rollers 25 do not spring out because they are held by the inside walls 114 of the channels 38 which serves as cams to guide rollers 25.

When the inner frame 9 is pushed up by the printing pressure springs 54, the inclined surface 63 at the top rear of the inner frame 9 pushes against and slides past the inclined surface 62 of the supporting member 24. The supporting member 24 is thereby urged toward the hand lever 5 which brings the rollers 25 into contact with the cam forming walls 21. Further, the width of the supporting member 24 is smaller than the width of the inner channel 22 between the inside walls 115 so that the supporting member 24 can be rocked within the space of the inner channel 22. Channel 22 is also a cam for guide rollers 25. As shown in FIG. 18*b*, when the hand lever 5 is squeezed, the hand lever 5 rises such that the rollers 25 are maintained in contact with the walls 21. When the lower ends of the walls 21 rise to the position of rollers 25, the rollers 25 are no longer held in the space or channel or cam between the walls 21 and the rear wall of the inner frame 9. The supporting member 24 is then pushed toward the hand lever 5 by the force of springs 54 biasing the inclined surface 62 to slip off the inclined surface 63 of the inner frame 9. The rollers 25 are shifted to the space below the guide passage 23.

By the shifting of the supporting members 24, the inner frame 9 becomes free and is pushed up by the spring force of the printing pressure springs 54, as shown in FIGS. 4 and 11*b*. Thus, the platen 10 is pressed against the type face 8 of the printing device 6, as described above. Simultaneously with this printing stroke, the push back spring lugs 61 press the back springs 106 by raising up the pins 107.

Figure 11C:
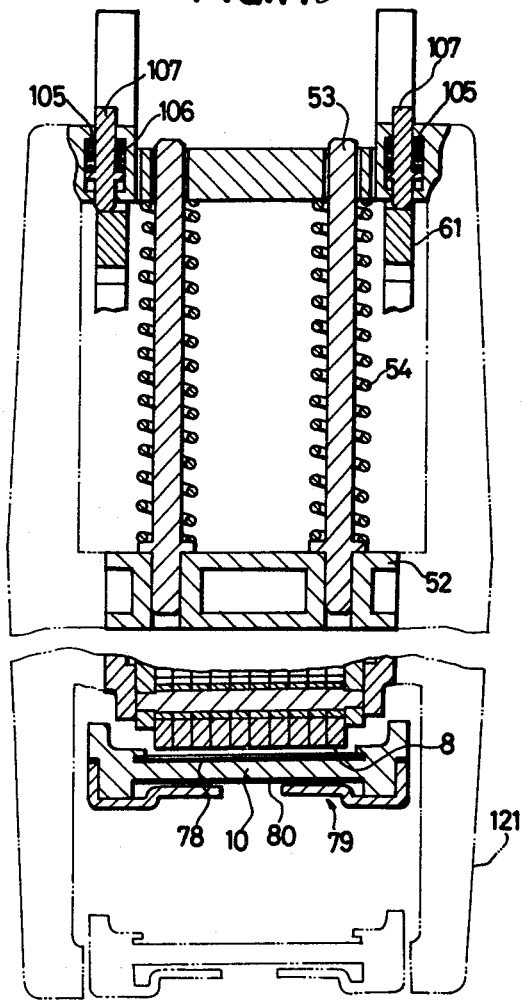

As shown in FIGS. 5 and 11*c*, the inner frame 9 is pushed downward immediately after the upward movement by the reaction force of the printing stroke and by the spring force of the push back springs 106. The platen 10 stops a short distance from the type face 8.

When the hand lever 5 is released, the projections 64 from the inner frame 9 are forced down by the lower surfaces 29 of the projecting pieces 20 of the hand lever 5 as the hand lever 5 descends. When the inner frame 9 is lowered, the rollers 25 are introduced into the guide passages 23 and the rollers slide up the inside walls 115 of the inner channel 22 or cam as the hand lever 5 and inner frame 9 moves down. When the rollers 25 reach the upper portions of the inside walls 115, the rollers 25 move free of the guide passages 23 and the supporting member 24 is urged toward the inner frame 9 by the force of the spring 110. The inclined surface 62 again rests on the inclined surface 63 at the top of the inner frame 9 and the rollers 25 are against the inside walls 114 of the outer channel 38. Since the rollers 25 are pushed outwards by the inner spring 112, they are caused to contact the inside walls 114 and walls 21, as shown in FIGS. 6, 7*a*-1 and 7*a*-2.

The present invention is not restricted to the above embodiment. For example, the holder 3 may be integral with the inner frame 9 to move together with it so as to keep the label strip from developing slack as the label strip holder remains stationary while the frame 9 shifts. Furthermore, it is not necessary for the platen and the advancing mechanism to move together.

The operation of the labeler just described is now explained.

To load the wound label strip 78 into the label holder 3, the holder 3 is manually swung open in the direction of arrow A in FIG. 3 around pin 4 relative to the labeler body, and a rolled label strip 78 is set into the holder 3. Then the free end of the label strip 78 is inserted through the inner frame 9. As shown in FIG. 9*b*, the grip piece 92 of the pushing device 76 is pulled toward the grip 2 so as to stand the guide spring plate 74 upright. Also, the guide member 77 is separated from the rotating member 72 by moving the bottom cover 79 clockwise around the shaft 100.

The free end of the label strip 78 is passed through the space between the guide spring plate 74 and the rotating member 72, then through the passage formed between the platen 10 and the guide plate 102, and then to the upper surface of the released bottom cover 79. There only the backup strip 80 is doubled over around the front end of the platen 10 and it is led over the lower surface of the rotating member 72.

The grip piece 92 is next returned toward the inner frame 9 so as to fit the label strip 78 on the outer surface of the rotating member 72 by the guide spring plate 74. The bottom cover 79 is returned to its closed position. In the operation, the slits 88 through the lable strip 78 and the slits 89 through the backup strip 80 must be so disposed as to be engaged by the advancing teeth 81 of the rotating member 72. The holder 3 is also returned counterclockwise to its original position.

When the hand lever 5 is squeezed, as shown in FIGS. 18*a*, *b* and *c*, the rocking lever 35 is rocked around the pin 37 by the interconnection of projecting piece 20, bell crank and link 33. This moves the ink impregnated roller 50 forward across the type face 8 of the printing device 6 to apply ink to it.

Figure 10B:
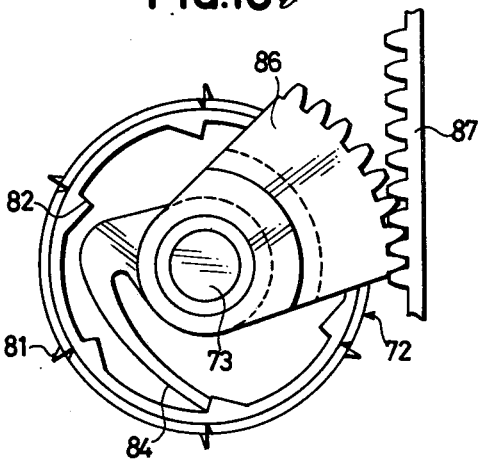
Figure 10C:
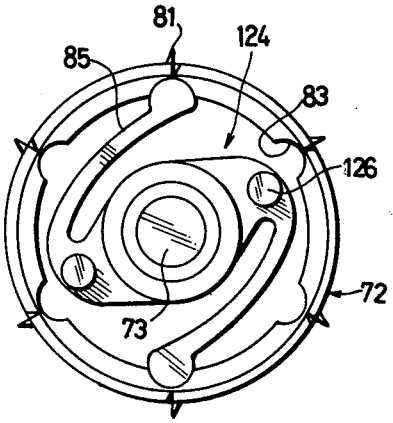

As hand lever 5 rises, the walls 21 attached to the lever 5 also rise. As shown in FIGS. 4, 7*b*-1 and 7*b*-2, when the walls 21 rise above the rollers 25, the surfaces 62 and 63 separate and the supporting member 24 is shifted toward the hand lever 5 which frees the frame 9 to rise. The inner frame 9 is pushed up by the force of the printing pressure springs 54. During the ascent of the inner frame 9, the sector gear 86 is turned clockwise by the stationary rack 87, as shown in FIGS. 10*a*, 10*b* and 10*c*. However, corresponding rotation of the rotating label strip feed member 72 is stopped by the reverse rotation preventing pawls 85 and the rotating pawl 84 slides over one projection 82. Accordingly, the label strip 78 and the backup strip 80 do not advance.

The platen 10 of the inner frame 9 is caused to move a label to strike the type face 8 of the printing device 6. Thus, the label 125 of the label strip 78 positioned on the platen 10 is printed. After this, as shown in FIGS. 5 and 11*c*, the inner frame 9 is slightly returned downward by the bounce reaction to striking of the printing device 6 and by the force of the push back springs 106. The platen 10 is brought into contact with the printing device 6 with constant force and for a constant time period. Therefore, a clear printing on the surface of label 125 will always be obtained irrespective of the manner in which the hand lever 5 is squeezed.

As shown in FIGS. 7*c*-1 and 7*c*-2 and 18*d*, when the hand lever 5 is released, it is pushed down by the force of the compression spring 18. The rollers 25 of the supporting member 24 are guided into the guide passages 23 during this descent. Meanwhile, the projections 64 of the inner frame 9 are pushed down by the lower surfaces 29 of the projecting pieces 20 on the hand lever 5. Thus, the inner frame 9 is lowered and the printing pressure springs 54 are compressed. When the rollers 25 of the supporting member 24 slide up on the inside walls 115 of the inner channel 22 during the lowering of the hand lever 5 and the rollers 25 become free and the inclined surface 62 engages with the inclined surface 63 of the inner frame 9, the supporting member 24 is urged toward the inner frame 9 by the force of the spring 110, as shown in FIGS. 3, 6, 7*a*-1 and 7*a*-2. Further, the rollers 25 drop along the surface 114 of the outer channel 38 and they are not moved toward the hand lever 5 because they contact with the walls 21. Therefore, the inner frame 9 is held there against the force of the compressed printing pressure springs 54.

During the descent of the inner frame 9, the sector gear 86 is in engagement with the rack 87, as shown in FIGS. 10*a* and *b*. The sector gear 86 and the integral rotating pawl 84 are rotated and an inner projection 82 and the rotating member 72 are forced to rotate, thereby moving the length of one label 125. Since the advancing teeth 81 are in engagement with the slits 88 of the label strip 78 and the slits 89 of the backup strip 80, when the rotating member 72 is rotated, both the label strip 78 and backup strip 80 are advanced for one label length. The label 125 of the label strip 78 is separated from the backup strip 80 in the label peeling section 58, and the peeled label 125 reaches a position below the label applicator 59. Thus, the printed label 125 can be applied to the surface of an article with the label applicator 59.

Figure 18D:
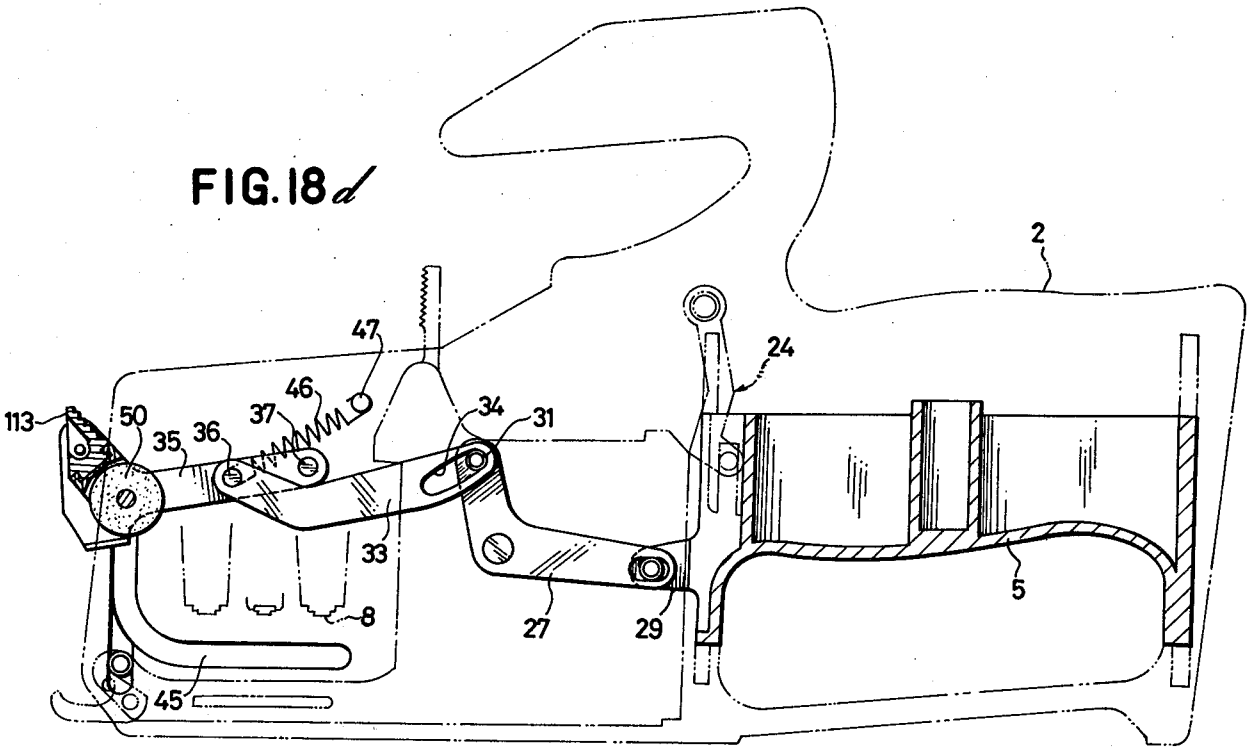
Figure 18E:
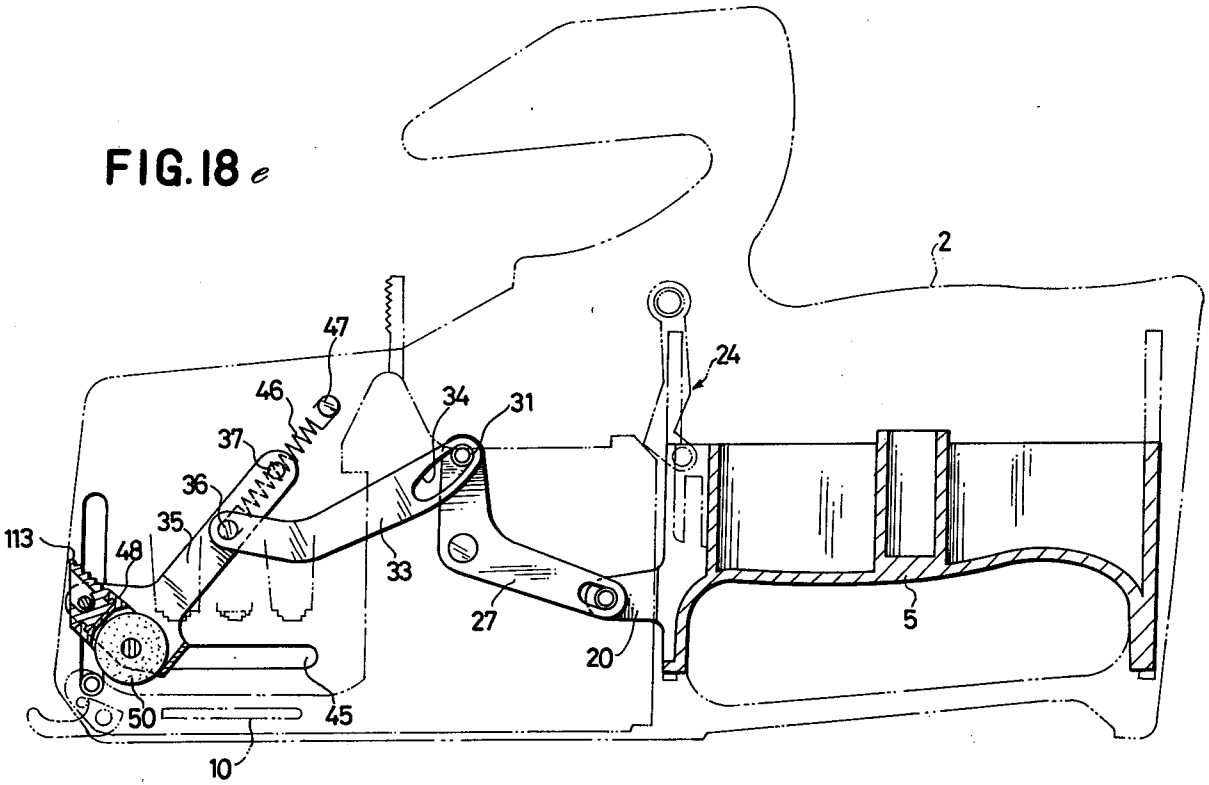

Meanwhile, the inking device 7 is returned to its original position. As shown in FIG. 18*d*, during the return stroke of the hand lever 5, when the roller 31 on the bell crank 27 reaches the right hand end portion of the slot 34 of the link 33, the rocking lever 35 is rotated counterclockwise around the pin 37 until the pins 36, 37 and 47 align on a straight line. After the pin 36 moves past the aforesaid alignment toward the hand lever 5, the inking device 7 is snap returned to the position shown in FIGS. 3 and 18*a* by the force of the spring 46.

By repeating the above-disclosed operation, the labels 125 are applied to articles one by one.

The device for controlling the printing pressure exerted by the platen may be formed as in the second embodiment, which is shown in FIGS. 20, 21, 22 and 23.

In the second embodiment, the hand lever 5 is pivotally connected to side walls 121 and 122 (the side wall 121 is not shown in the drawing) by a shaft 201 and the lever 5 is biased to the downward or rest position by a tension spring 18 stretched between an upright lug 202 on the lever 5 and a pin 203 positioned in the rear portion of the grip 2. The tension spring 18 for driving the hand lever 5 away from the grip 2 is stronger than the printing pressure springs 54 so that spring 18 can push down or return the inner frame 9 and platen 10. A forward projection 204 extends forward of the lever 5.

A U-shaped action lever 205 moves the inner frame 9 vertically. The lever 205 is provided with a pair of shafts 206 on both sides thereof and the shafts 206 are pivotally supported by the side walls 121 and 122 of the housing 1. The action lever 205 is rocked around the shafts 206 by the action of the hand lever 5. The action lever 205 has a concavity 207 at its rear end which receives the forward projection 204 of the hand lever 5. The front portion of the action lever 205 carries rollers 208, which engage the beams 209 of the inner frame 9.

Figure 20:
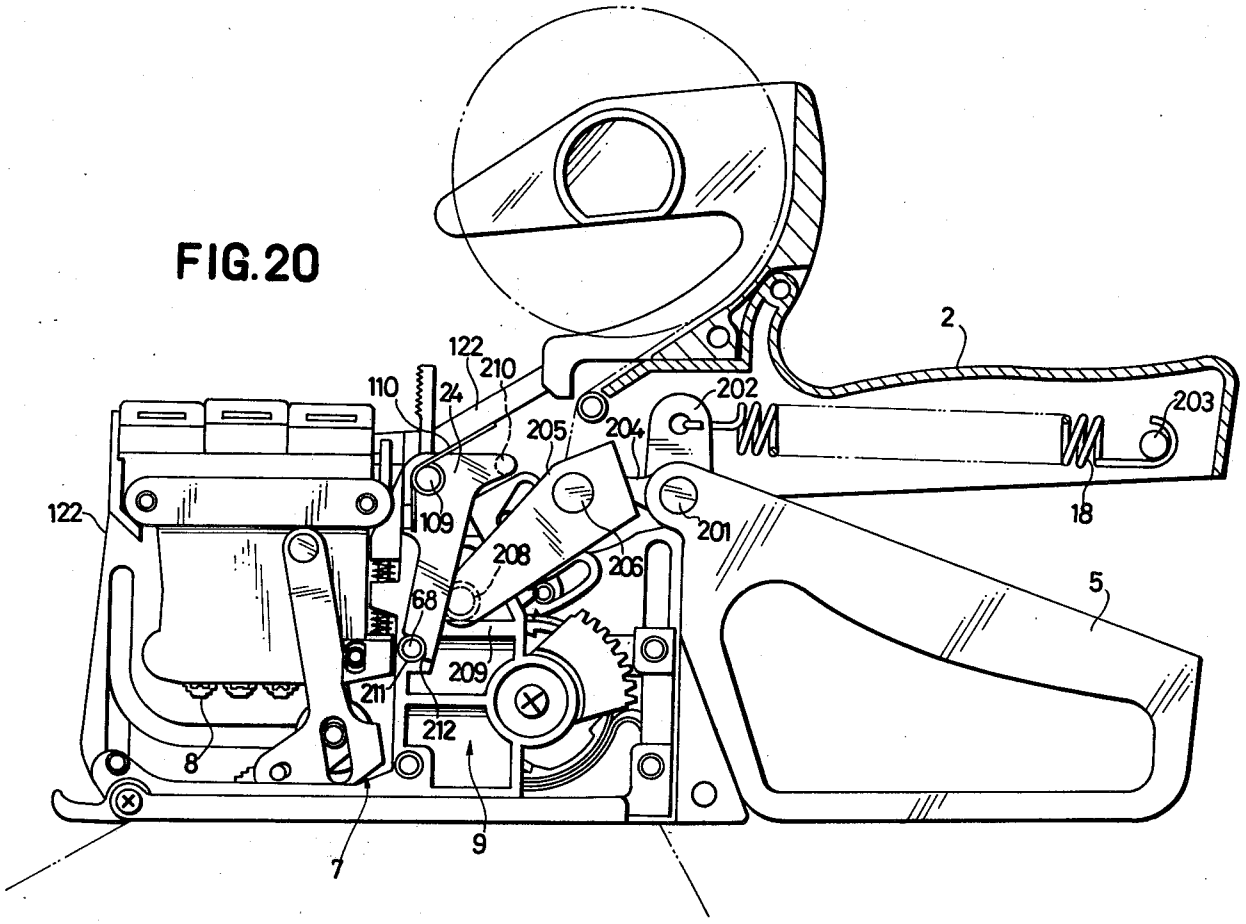
FIG. 20 is a side view, partially in cross-section, of a labeler provided with a second embodiment of the constant printing pressure mechanism of the invention, in which the near side wall of the labeler has been removed.
Figure 21:
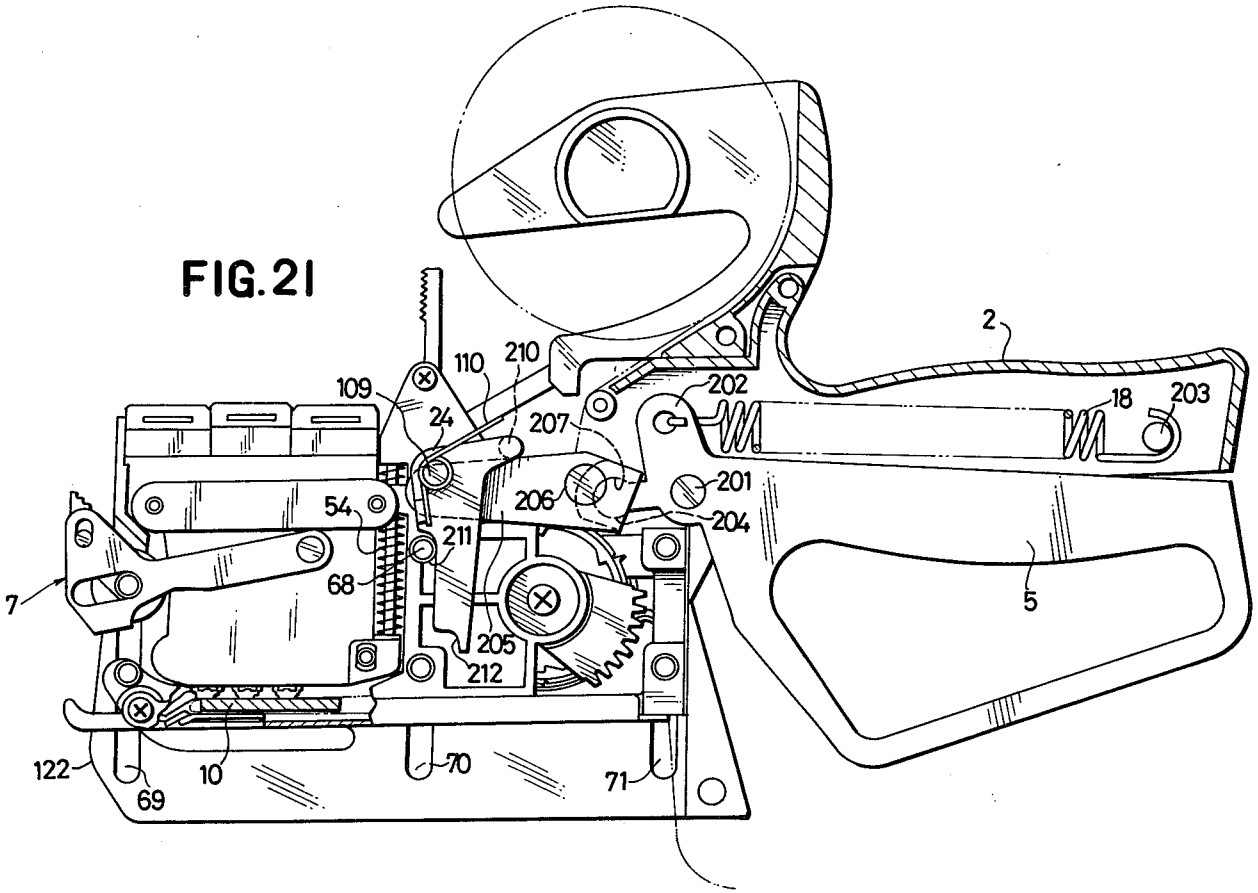
FIG. 21 is a side view similar to FIG. 20, where the hand lever has been squeezed.
Figure 22:
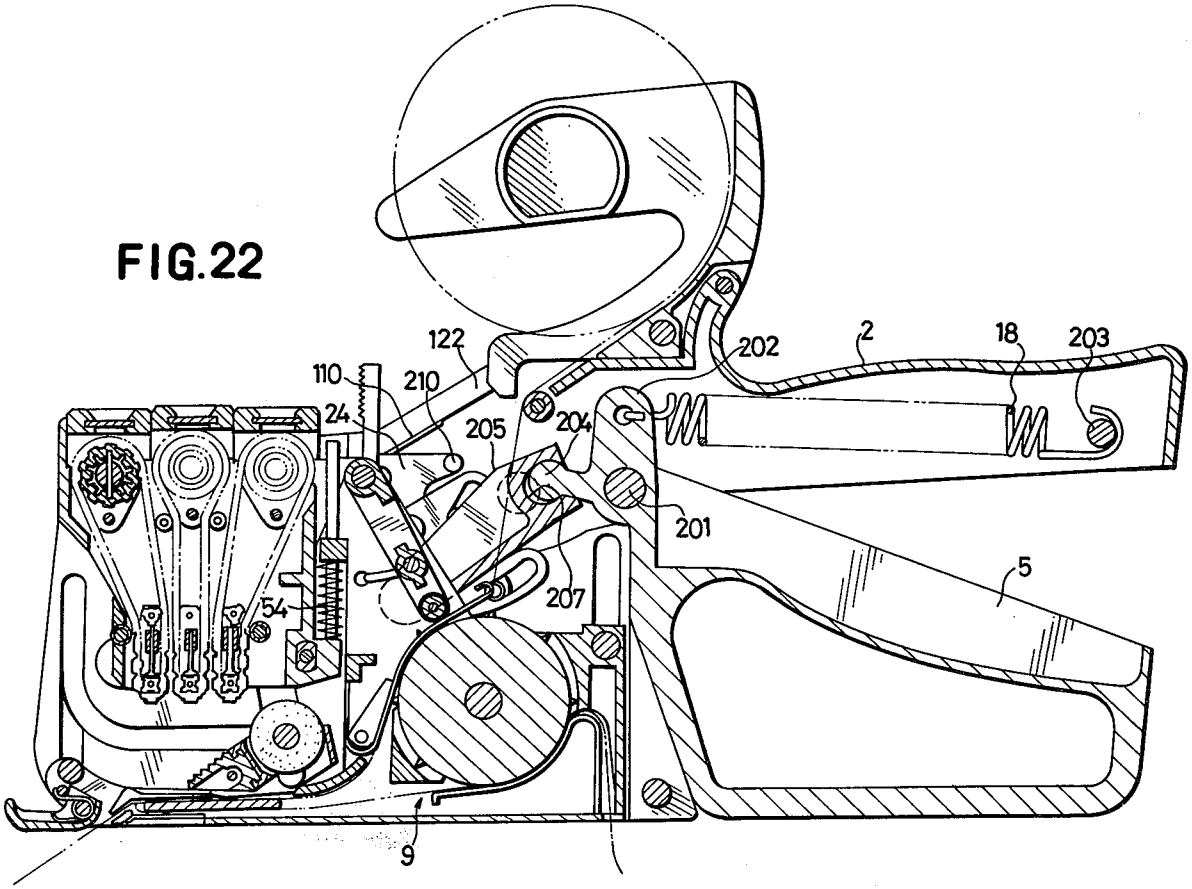
FIG. 22 is a central cross-sectional view of the labeler of FIG. 20.

The inner frame 9 is held at the normal lower rest position by supporting members 24 which are pivotally connected to the side walls 121 and 122 by shaft 109. As shown in FIG. 20, the supporting members 24 are urged clockwise by the torsion spring 110 wrapped around the shaft 109. Stop pieces 212 are formed at the lower ends of the supporting members 24 and projections 210 are formed on the insides of the upper rear ends of members 24 above the action lever 205. When the inner frame 9 is lowered, the stop pieces 212 are biased by spring 110 to engage the rollers 211 which are pivotally supported on the pins 68 attached on both sides of the inner frame 9. As shown in FIG. 21, the projections 210 are pushed up by the upper cam surface of the action lever 205 when the lever 205 is moved by squeezing of the hand lever 5.

Figure 23:
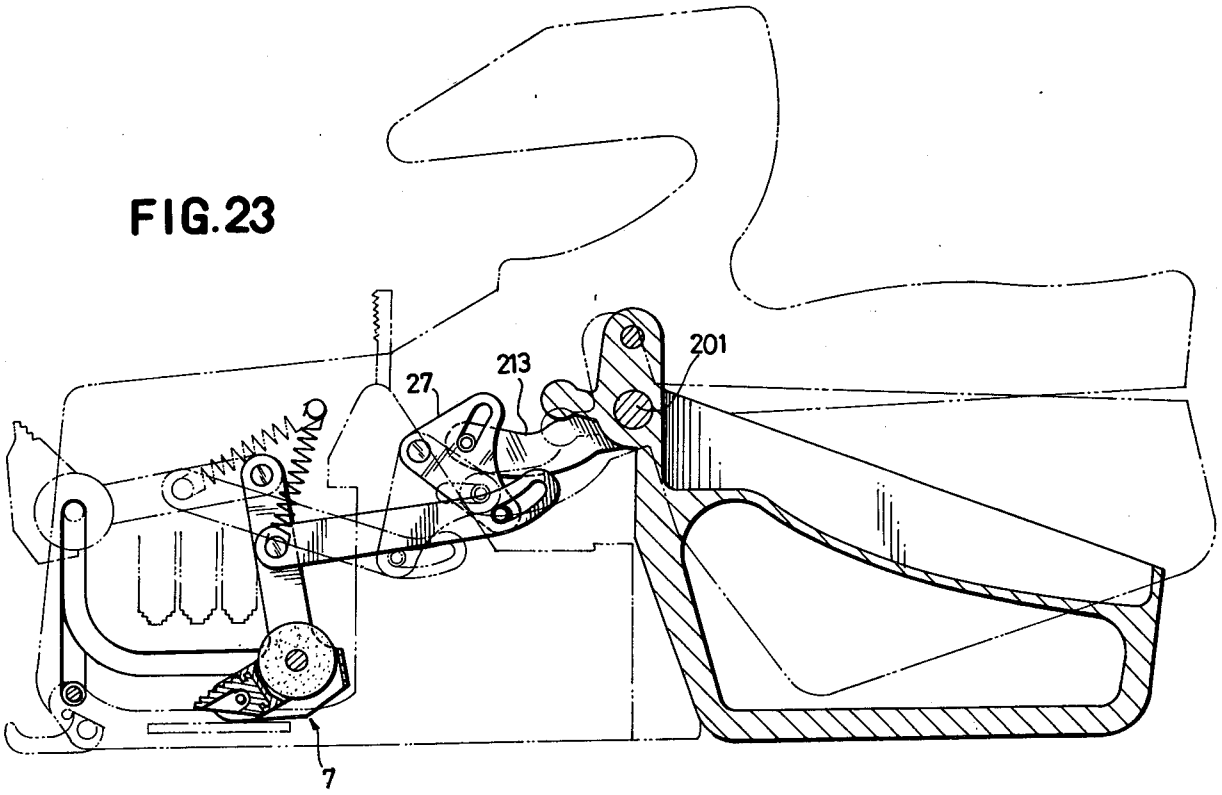
FIG. 23 shows the operation of the inking device of the second embodiment.

In the same manner as other guide rollers (not identified with numerals), the rollers 211 of frame 9 are guided in the guide grooves 70 formed on the side walls 121 and 122 so as to guide the inner frame 9 to move vertically. Further, because the hand lever 5 is rocked around the shaft 201, as shown in FIG. 23, the inking device 7 is moved by the arcuate motion of the lever 213 according to the motion of the hand lever 5 through bell crank 27 pivotally supported by the side walls 121, 122. Other parts and devices of this embodiment are the same as those of the former embodiment so that an explanation for them is omitted here.

In the second embodiment, when the hand lever 5 is squeezed as shown in FIG. 21, the action lever 205 is turned clockwise around the shafts 206 and the rollers 208 are raised. Just before the hand lever 5 reaches the upper extreme of its stroke, the upper cam surface of the action lever 205 contacts the projections 210 of the supporting member 24. This rotates the supporting members 24 counterclockwise against the force of the springs 110. The stop pieces 212 of the supporting members 24 are released from the rollers 211 of the inner frame 9. Then as in the first embodiment, the inner frame 9 is quickly pushed up under the force exerted by the printing pressure springs 54. Thus, the platen 10 is raised to the type face 8 of the printing device 6, and thereafter the platen 10 is slightly lowered from the type face 8.

When the hand lever 5 is released and the action lever 205 is moved counterclockwise around the shafts 206 by the force of the helical spring 18, the rollers 208 move back along the beams 209 of the inner frame 9 and the frame 9 is pushed down.

When the hand lever 5 has returned to its start position, the rollers 211 of the inner frame 9 have moved toward the lower sides of stop pieces 212 of the supporting members 24, while the stop pieces 212 are urged toward the rollers 211 by the force of springs 110 attached to the supporting members 24. Thus, the stop pieces 212 are caught by the rollers 211 and the inner frame 9 is held at its lower position until the next squeezing of the hand lever 5.

It will be understood from the foregoing disclosure that when the labeler of the present invention is used, even and clear printing of labels can be performed independently of the manner of squeezing of the hand lever. The quality of printing is not influenced by the strength or speed of the hand lever squeezing and releasing.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A hand labeler, comprising:

a body frame;

a printing device supported on said body frame;

a platen assembly in said body frame including a platen for carrying a label strip; said platen assembly being movably supported and positioned in said body frame such that a label on said platen confronts said printing device;

biasing means connected with said platen assembly for normally biasing said platen toward confrontation with said printing device;

platen assembly motion restraining means connected with said platen assembly for blocking motion of said platen toward confrontation with said printing device under the bias of said biasing means;

a grippable hand lever supported by said body frame and connected with said restraining means for moving said restraining means off said platen assembly as said hand lever is gripped, whereby said platen assembly is freed to shift for said platen to confront said printing device under the bias of said biasing means;

separation means supported on said body frame, separate from said hand lever and normally separate from said platen, at a position so that the separation means is engaged by said platen only as said platen confronts said printing device for moving said platen off said printing device after their initial confrontation caused by said biasing means; said separation means being positioned for being engaged by said platen while said hand lever is still being gripped.

2. The hand labeler of claim 1, wherein said separation means comprises an abutment biased in opposition to said biasing means with a force greater than that of said biasing means when said platen and said abutment abut and said abutment being positioned to be abutted by said platen assembly when said platen confronts said printing device.

3. The labeler of claim 2, further comprising second biasing means for biasing said abutment.

4. The labeler of claim 2, further comprising platen return means for returning said platen assembly from confrontation with said printing device.

5. The labeler of claim 4, further comprising restraining means return means on said hand lever and also connected with said restraining means for returning said restraining means to block motion of said platen toward confrontation with said printing device when said hand lever is released.

6. The hand labeler of claim 5, wherein said restraining means comprises an arm connected to said body frame and movable between a first position at which said arm blocks said platen assembly from moving toward confrontation with said printing device and a second position at which said arm frees said platen assembly to move toward confrontation with said printing device;

said restraining means return means being engageable with said arm to move said arm to its said first position.

7. The hand labeler of claim 6, wherein said restraining means and its said return means comprise cam means connected to said hand lever for engaging said arm and for holding said arm at its said first position until said hand lever has been gripped and for holding said arm at its said second position until said platen assembly and said hand lever have respectively returned and retracted, and said restraining means return means further comprising biasing means connected with said arm to bias same toward its said first position.

8. The hand labeler of claim 7, wherein said arm is pivotally attached to said body frame and pivots between its said first and said second positions;

cooperating means on said arm and on said platen assembly for enabling said arm to pivot free of said platen assembly toward said second position; said cam means being so shaped as to enable said arm to pivot toward said second position when said hand lever has been gripped.

9. The hand labeler of claim 8, wherein said printing device is fixedly mounted to said body frame, and said platen assembly moves to confront said printing device.

10. The hand labeler of claim 5, wherein said restraining means comprises an arm pivotally connected to said body frame and pivotable between a first and a second pivot position;

said arm and said platen assembly having respective engaging surfaces shaped and positioned such that when said arm is held in said first position, said respective engaging surfaces engage and said arm blocks said platen assembly from shifting under influence of said biasing means to confront said printing device;

said engaging surfaces being so shaped that said arm is normally urged by said engaging surfaces to slide and pivot free of said platen assembly, thereby to shift said arm to its said second position;

a first cam on said hand lever and positioned to engage said arm and to hold same in its said first position as said hand lever is gripped; said first cam being of a size such that after said hand lever has been gripped to a predetermined extent, said arm disengages from said first cam and is free to shift to its said second position;

a second cam on said hand lever and positioned and shaped to be engaged by said arm as said arm is freed of said first cam to hold said arm in its said second position until both said platen assembly and said hand lever have respectively returned and retracted, and said second cam then being shaped such that said arm is freed from said second cam;

said restraining means return means comprises said cams and second biasing means connected with said arm for normally biasing said arm toward its said first position.

11. The hand labeler of claim 10, wherein said first cam comprises a first channel defined in said hand lever and extending along said hand lever along the direction of the gripping and releasing motion of said hand lever, and said first channel being relatively closer to said platen assembly, thereby to hold said arm in its said first position;

said second cam comprises a second channel defined in said hand lever and extending along said hand lever along the direction of the gripping and releasing motion of said hand lever; said second channel being farther from said platen assembly than said first channel, thereby to hold said arm in its said second position when said arm engages said second channel;

a cam follower on said arm and selectively engageable in one of said first and said second cam channels.

12. The hand labeler of claim 11, wherein said engaging surfaces on said arm and on said platen assembly are inclined surfaces, which are inclined to cause said arm to slip off said platen assembly and away from said arm first position and to enable said arm to shift toward its said second position.

13. The hand labeler of claim 12, further comprising an inner frame located in said body frame; said platen assembly being supported on said inner frame; said inner frame being movable toward and away from said printing device as said platen assembly respectively moves toward and away from confrontation with said printing device;

said inclined surface of said platen assembly being formed on said inner frame; said biasing means for said platen assembly acting upon said inner frame.

14. The hand labeler of claim 4, wherein said restraining means comprises an arm pivotally connected to said body frame and pivotable between a first and a second pivot position;

said arm and said platen assembly having respective engaging surfaces shaped and positioned such that when said arm is held in said first position, said respective engaging surfaces engage and said arm blocks said platen assembly from shifting under influence of said biasing means to confront said printing device;

a first cam connected to said hand lever and being pivotally mounted to said body frame, whereby gripping motion of said hand lever pivots said first cam in a first direction; said first cam being shaped and positioned to engage said arm as said first cam pivots in said first direction to pivot said arm to its said second position.

15. The hand labeler of claim 14, further comprising restraining means return means comprising second biasing means connected with said arm for normally biasing said arm to said first position.

16. The hand labeler of claim 15, wherein said hand lever is pivotally connected to said body frame at a pivot mount, whereby said hand lever pivots as it is gripped.

17. The hand labeler of claim 16, wherein said cam is part of an action lever; said action lever being pivotally mounted to said body frame at a second pivot mount spaced from said hand lever pivot mount; said hand lever and said action lever being pivotally connected.

18. The hand labeler of claim 4, further comprising an inner frame located in said body frame; said platen assembly being supported on said inner frame; said inner frame being movable toward and away from said printing device as said platen assembly respectively moves toward and away from confrontation with said printing device.

19. The hand labeler of claim 18, further comprising a label strip feeding and advancing mechanism in said labeler and comprising a pinion carried on said inner frame and movable therewith; a shaft in said inner frame on which said pinion rotates; said pinion rotating said shaft;

a label strip feed wheel on said inner frame shaft and rotatable therewith, said feed wheel being engageable with a label strip for advancing the label strip as said pinion rotates;

a rack affixed on said body frame and in engagement with said pinion for rotating said pinion as said inner frame moves.

20. The hand labeler of claim 19, further comprising ratchet means connected with said feed wheel for causing said feed wheel to rotate only in one direction while said inner frame shifts towards and away from said printing device, thereby advancing a label strip only in one direction.

21. The hand labeler of claim 19, further comprising a printing device inking means connected with said hand lever and being movable by said hand lever into engagement with said printing device to ink said printing device.

22. The hand labeler of claim 19, further comprising guide means on said inner frame and on said body frame for causing said inner frame and said platen assembly attached thereto to shift along a path toward and away from confrontation with said printing device without pivoting with respect to said printing device and said body frame.

23. The hand labeler of claim 22, wherein said guide means comprises a pin-in-slot guide, with said inner frame having one of said pin and said slot and said body frame having the other of said pin and said slot.

24. The hand labeler of claim 22, further comprising second guide means on said body frame and on said grippable lever for causing said grippable lever to be shiftable between its gripped and retracted positions without said hand lever pivoting with respect to said body frame.

25. The hand labeler of claim 1, further comprising platen assembly engaging means on said hand lever and positioned to engage said platen assembly when said hand lever is released from being gripped; said hand lever being retractable upon being released; upon release of said hand lever and retraction thereof, said platen assembly engaging means engages said platen assembly and returns said platen assembly away from confrontation with said printing device and moves said platen assembly against the bias of said biasing means.

26. The hand labeler of claim 25, further comprising second biasing means connected with said hand lever for normally biasing said hand lever to retract after being released from being gripped; said second biasing means being adapted to exert a greater biasing force than said first biasing means, whereby said second biasing means biases said hand lever to retract and also biases said platen assembly to return from confrontation with said printing device.

27. A hand labeler, comprising:

a body frame;

a printing device supported on said body frame;

a platen assembly in said body frame including a platen for carrying a label strip; said platen assembly being movably supported and positioned in said body frame such that a label on said platen confronts said printing device;

biasing means connected with said platen assembly for normally biasing said platen toward confrontation with said printing device;

platen assembly motion restraining means connected with said platen assembly for blocking motion of said platen toward confrontation with said printing device under the bias of said biasing means; said restraining means comprises an arm pivotally connected to said body frame and pivotable between a first and a second pivot position;

a grippable hand lever supported by said body frame and connected with said restraining means for moving said restraining means off said platen assembly as said hand lever is gripped, whereby said platen assembly is freed to shift for said platen to confront said printing device under the bias of said biasing means;

platen return means for returning said platen from confrontation with said printing device;

restraining means return means on said hand lever and also connected with said restraining means for returning said restraining means to block motion of said platen toward confrontation with said printing device when said hand lever is released;

said arm and said platen assembly having respective engaging surfaces shaped and positioned such that when said restraining means arm is held in said first position, said respective engaging surfaces engage and said arm blocks said platen assembly from shifting under influence of said biasing means to confront said printing device;

said engaging surfaces being so shaped that said arm is normally urged by said engaging surfaces to slide and pivot free of said platen assembly, thereby to shift said arm to its said second position;

a first cam on said hand lever and positioned to engage said arm and to hold same in its said first position as said hand lever is gripped; said first cam being of a size such that after said hand lever has been gripped to a predetermined extent, said arm disengages from said first cam and is free to shift to its said second position;

a second cam on said hand lever and positioned and shaped to be engaged by said arm as said arm is freed of said first cam to hold said arm in its said second position until both said platen assembly and said hand lever have respectively returned and retracted, and said second cam then being shaped such that said arm is freed from said second cam;

said restraining means return means comprises said cams and second biasing means connected with said arm for normally biasing said arm toward its said first position.

28. A hand labeler comprising:

a body frame;

a printing device supported on said body frame;

a platen assembly in said body frame including a platen for carrying a label strip; said platen assembly being movably supported and positioned in said body frame such that a label on said platen confronts said printing device;

biasing means connected with said platen assembly for normally biasing said platen toward confrontation with said printing device;

platen assembly motion restraining means connected with said platen assembly for blocking motion of said platen toward confrontation with said printing device under the bias of said biasing means; said restraining means comprises an arm pivotally connected to said body frame and pivotable between a first and a second pivot position;

a grippable hand lever supported by said body frame and connected with said restraining means for moving said restraining means off said platen assembly as said hand lever is gripped, whereby said platen assembly is freed to shift for said platen to confront said printing device under the bias of said biasing means;

platen return means for returning said platen from confrontation with said printing device;

restraining means return means on said hand lever and also connected with said restraining means for returning said restraining means to block motion of said platen toward confrontation with said printing device when said hand lever is released;

said arm and said platen assembly having respective engaging surfaces shaped and positioned such that when said restraining means arm is held in said first position, said respective engaging surfaces engage and said arm blocks said platen assembly from shifting under influence of said biasing means to confront said printing device;

a first cam connected to said hand lever and being pivotally mounted to said body frame, whereby gripping motion of said hand lever pivots said first cam in a first direction; said first cam being shaped and positioned to engage said arm as said first cam pivots in said first direction to pivot said arm to its said second position.

* * * * *